US011065868B2

(12) United States Patent
Martensson et al.

(10) Patent No.: US 11,065,868 B2
(45) Date of Patent: Jul. 20, 2021

(54) JETTING DEVICES WITH ACOUSTIC TRANSDUCERS AND METHODS OF CONTROLLING SAME

(71) Applicant: Mycronic AB, Taby (SE)

(72) Inventors: Gustaf Martensson, Taby (SE); Jesper Sallander, Taby (SE)

(73) Assignee: Mycronic AB, Taby (SE)

( * ) Notice: Subject to any disclaimer, the term of this patent is extended or adjusted under 35 U.S.C. 154(b) by 0 days.

(21) Appl. No.: 16/630,054

(22) PCT Filed: Jun. 29, 2018

(86) PCT No.: PCT/EP2018/067622
§ 371 (c)(1),
(2) Date: Jan. 10, 2020

(87) PCT Pub. No.: WO2019/011674
PCT Pub. Date: Jan. 17, 2019

(65) Prior Publication Data

US 2020/0230953 A1 Jul. 23, 2020

(30) Foreign Application Priority Data

Jul. 12, 2017 (SE) ..... 1730189-6

(51) Int. Cl.
*B41J 2/045* (2006.01)

(52) U.S. Cl.
CPC ..... *B41J 2/04571* (2013.01); *B41J 2/0456* (2013.01); *B41J 2/04575* (2013.01)

(58) Field of Classification Search
CPC .. B41J 2/04571; B41J 2/0456; B41J 2/04575; B41J 2/14008; B41J 2/14201; B41J 2/04581; B41J 2/04588
See application file for complete search history.

(56) References Cited

U.S. PATENT DOCUMENTS 4,046,073 A 9/1977 Mitchell et al.
5,880,759 A 3/1999 Silverbrook
(Continued)

FOREIGN PATENT DOCUMENTS

CN 201316685 Y 9/2009
EP 0933212 A2 8/1999
(Continued)

OTHER PUBLICATIONS

International Search Report PCT/ISA/210 for International Application No. PCT/EP2018/067622 dated Sep. 14, 2018.

*Primary Examiner* — Bradley W Thies
(74) *Attorney, Agent, or Firm* — Harness, Dickey & Pierce, P.L.C.

(57) ABSTRACT

A jetting device configured to jet one or more droplets of a viscous medium through a nozzle may include an acoustic transducer configured to emit an acoustic signal that transfers acoustic waves into at least a portion of the viscous medium located in a viscous medium conduit a viscous medium conduit configured to direct a flow of the viscous medium to an outlet of the nozzle. The acoustic signal may be an ultrasonic signal. The acoustic signal may adjust one or more rheological properties of the viscous medium, based on acoustic actuation. The acoustic transducer may be implemented by an actuator of the device that is configured to move through an eject chamber to cause viscous medium to be jetted through the outlet of the nozzle as one or more droplets.

20 Claims, 10 Drawing Sheets

(56) References Cited

U.S. PATENT DOCUMENTS

| | | | | |
|---|---|---|---|---|
| 5,953,027 | A | 9/1999 | Suwabe et al. | |
| 2001/0038402 | A1* | 11/2001 | Percin | B41J 2/04 347/54 |
| 2003/0020788 | A1* | 1/2003 | Asano | B41J 2/175 347/85 |
| 2014/0263724 | A1 | 9/2014 | Ovchinnikov et al. | |
| 2015/0274371 | A1 | 10/2015 | Fliess et al. | |
| 2017/0001439 | A1 | 1/2017 | Foresti et al. | |

FOREIGN PATENT DOCUMENTS

| | | | |
|---|---|---|---|
| EP | 1013421 | A2 | 6/2000 |
| EP | 1013421 | A3 | 8/2001 |
| EP | 1228875 | A1 | 8/2002 |
| EP | 1527877 | A1 | 5/2005 |
| EP | 1872952 | A1 | 1/2008 |
| JP | 2006-150248 | A | 6/2006 |
| JP | 2009-143126 | A | 7/2009 |
| JP | 2017-065138 | A | 4/2017 |
| WO | WO-9014233 | A1 | 11/1990 |
| WO | WO-9964167 | A1 | 12/1999 |

* cited by examiner

JETTING DEVICES WITH ACOUSTIC TRANSDUCERS AND METHODS OF CONTROLLING SAME

CROSS-REFERENCE TO RELATED APPLICATIONS

This application is a national phase under 35 U.S.C. § 371 of PCT International Application No. PCT/EP2018/067622 which has an International filing date of Jun. 29, 2018, which claims priority to Swedish Application No. 1730189-6, filed Jul. 12, 2017, the entire contents of each of which are hereby incorporated by reference.

BACKGROUND

Technical Field

Example embodiments described herein generally relate to the field of "jetting" droplets of a viscous medium onto a substrate. More specifically, the example embodiments relate to improving the performance of a jetting device, and a jetting device configured to "jet" droplets of viscous medium onto a substrate.

Related Art

Jetting devices are known and are primarily intended to be used for, and may be configured to implement, jetting droplets of viscous medium, e.g. solder paste or glue, onto a substrate, e.g. an electronic circuit board, prior to mounting of components thereon. An example of such a jetting device is disclosed in WO 99/64167, incorporated herein by reference in its entirety.

A jetting device may include a nozzle space (also referred to herein as an eject chamber) configured to contain a relatively small volume of viscous medium prior to jetting, a jetting nozzle (also referred to herein as an eject nozzle) coupled to (e.g., in communication with) the nozzle space, an impacting device configured to impact and jet the viscous medium from the nozzle space through the jetting nozzle in the form of droplets, and a feeder configured to feed the medium into the nozzle space.

Since production speed is a relatively important factor in the manufacturing of electronic circuit boards, the application of viscous medium is typically performed "on the fly" (i.e., without stopping for each location on the workpiece where viscous medium is to be deposited). A further way to improve the manufacturing speed of electronic circuit boards is to eliminate or reduce the need for operator interventions.

In some cases, good and reliable performance of the device may be a relatively important factor in the implementation of the above two measures, as well as a high degree of accuracy and a maintained high level of reproducibility during an extended period of time. In some cases, absence of such factors may lead to unintended variation in deposits on workpieces, (e.g., circuit boards), which may lead to the presence of errors in such workpieces. Such errors may reduce reliability of such workpieces. For example, unintended variation in one or more of deposit size, deposit placement, deposit shape, etc. on a workpiece that is a circuit board may render the circuit board more vulnerable to bridging, short circuiting, etc.

In some cases, good and reliable control of droplet size may be a relatively important factor in the implementation of the above two measures. In some cases, absence of such control may lead to unintended variation in deposits on workpieces, (e.g., circuit boards), which may lead to the presence of errors in such workpieces. Such errors may reduce reliability of such workpieces. For example, unintended variation in one or more of deposit size, deposit placement, deposit shape, etc. on a workpiece that is a circuit board may render the circuit board more vulnerable to bridging, short circuiting, etc.

U.S. Pat. No. 4,046,073 to Mitchell discloses a printing system that is configured to transfer ink from an ink-bearing medium (e.g., an ink ribbon, carbon paper or the like) to a printing medium (e.g., paper) with which the ink-bearing medium is in contact. Acoustic energy may be applied to the ink-bearing medium to cause the viscosity of the ink borne in the ink-bearing medium to become reduced, due to the acoustic vibrations and conversion of the acoustic energy into heat, such that the ink is transferred from the ink-bearing medium to the printing medium.

SUMMARY

According to some example embodiments, a device configured to jet one or more droplets of a viscous medium may include a nozzle, a viscous medium conduit, and an acoustic transducer. The nozzle includes an outlet, and the nozzle may be configured to jet the one or more droplets through the outlet of the nozzle. The viscous medium conduit may be configured to direct a flow of the viscous medium to the outlet of the nozzle. The acoustic transducer may be configured to emit an acoustic signal that transfers acoustic waves into at least a portion of the viscous medium located in the viscous medium conduit.

The viscous medium conduit may at least partially define an eject chamber in fluid communication with the outlet of the nozzle. The eject chamber may be configured to receive a portion of an actuator to move viscous medium located within the eject chamber through the outlet of the nozzle. The acoustic transducer may be configured to emit an acoustic signal that transfers acoustic waves into viscous medium located within the eject chamber.

The device may further include an actuator configured to induce the flow of the viscous medium through the viscous medium conduit. The portion of the viscous medium conduit may at least partially enclose the actuator.

The acoustic transducer may include a plurality of acoustic transducers. Each acoustic transducer may be to emit acoustic signals that transfer acoustic waves into a separate portion of the viscous medium conduit. Each acoustic transducer may be further configured to be separately and independently controlled to emit separate, respective acoustic signals into viscous medium located in the separate, respective portions of the viscous medium conduit.

The device may include a control device that may be configured to control the acoustic transducer to emit the acoustic signal based at least in part upon the jetting of one or more droplets through the outlet of the nozzle.

The device may include a flow sensor that may be configured to generate flow data based on measuring the flow of the viscous medium through at least a portion of the viscous medium conduit. The device may further include control device configured to control the acoustic transducer to emit the acoustic signal based at least in part upon the flow data.

According to some example embodiments, a method for controlling a jetting of one or more droplets of a viscous medium through an outlet of a nozzle may include controlling a viscous medium supply and controlling an acoustic transducer. The viscous medium may be controlled to induce a flow of the viscous medium through a viscous medium conduit to the outlet of the nozzle. The acoustic transducer may be controlled to emit an acoustic signal into at least a portion of the viscous medium that is located within the viscous medium conduit.

Controlling the acoustic transducer may include commanding the acoustic transducer to emit the acoustic signal for a particular, limited period of time.

Controlling the acoustic transducer may include commanding the acoustic transducer to emit the acoustic signal based on the viscous medium supply being controlled to induce the flow of the viscous medium.

The viscous medium conduit may at least partially define an eject chamber in fluid communication with the outlet of the nozzle. The eject chamber may be configured to receive a portion of an actuator to move viscous medium within the eject chamber through the outlet of the nozzle. Controlling the acoustic transducer may include commanding the acoustic transducer to emit the acoustic signal based on the actuator being controlled to extend into the eject chamber.

The acoustic transducer may include a plurality of acoustic transducers. One or more acoustic transducers may be configured to be in direct fluid communication with a portion of the viscous medium conduit. In some example embodiments, one or more acoustic transducers may be isolated from direct fluid communication with the viscous medium conduit and may be configured to emit acoustic signals that propagate through at least a portion of the jetting device (e.g., a housing) to transfer acoustic waves to viscous medium in at least a portion of the viscous medium conduit. Controlling the acoustic transducer may include separately and independently commanding the separate, respective acoustic transducers of the plurality of acoustic transducers to emit separately, respective acoustic signals into separate, respective portions of the viscous medium within the viscous medium conduit.

Controlling the acoustic transducer may include commanding the acoustic transducer to emit the acoustic signal based on flow data received from a flow sensor, the flow data indicating the flow of the viscous medium through at least a portion of the viscous medium conduit.

According to some example embodiments, an apparatus may include a jetting device and an acoustic transducer. The jetting device may be configured to jet one or more droplets of a viscous medium on a substrate. The acoustic transducer may be configured to emit an acoustic signal into at least a portion of the viscous medium to adjust one or more rheological properties of the portion of the viscous medium, based on acoustic actuation of the portion of the viscous medium.

The acoustic transducer may be configured to, based on the acoustic actuation of the portion of the viscous medium, induce at least one of increased homogeneity of spacing of particles in at least the portion of the viscous medium and shear-thinning of a carrier fluid in at least the portion of the viscous medium based on the acoustic actuation of the portion of the viscous medium, such that a viscosity of at least the carrier fluid is reduced. In some example embodiments, the induced increased homogeneity of spacing of particles may cause a viscosity of at least the carrier fluid to be increased. In some example embodiments, the acoustic transducer may be configured to adjust (e.g., increase or reduce) viscosity of at least the carrier fluid of the viscous medium based on acoustic actuation of the viscous medium intermittently, periodically, some combination thereof, or the like. For example, based on intermittent variations in homogeneity of at least the carrier fluid, the acoustic transducer may be configured to intermittently emit acoustic signals to increase homogeneity of at least the carrier fluid.

The jetting device may include a nozzle including an outlet. The nozzle may be configured to jet the one or more droplets through the outlet. The jetting device may further include a viscous medium conduit that at least partially defines an eject chamber in fluid communication with the outlet of the nozzle. The eject chamber may be configured to receive a portion of an actuator to move viscous medium within the eject chamber through the outlet of the nozzle. The acoustic transducer may be configured to emit an acoustic signal into viscous medium located within the eject chamber.

The jetting device may include a nozzle including an outlet. The nozzle configured to jet one or more droplets through the outlet. The jetting device may further include a viscous medium supply configured to induce a flow of viscous medium through a viscous medium conduit. The jetting device may further include a viscous medium conduit configured to direct the flow of viscous medium to the outlet of the nozzle. At least a portion of the viscous medium conduit may at least partially enclose the viscous medium supply. The viscous medium supply may include a motor configured to induce the flow of viscous medium, a pressurized supply configured to induce the flow of viscous medium, some combination thereof, or the like. The acoustic transducer may be configured to emit an acoustic signal that transfers acoustic waves into a portion of the viscous medium conduit.

The apparatus may include a control device configured to control the acoustic transducer to emit the acoustic signal based at least in part upon the jetting of one or more droplets.

The apparatus may include a flow sensor configured to generate flow data based on measuring a flow of viscous medium through at least a portion of a viscous medium conduit. The apparatus may include a control device configured to control the acoustic transducer to emit the acoustic signal based at least in part upon the flow data.

The acoustic transducer may include a plurality of acoustic transducers. Each acoustic transducer may be configured to be separately and independently controlled to emit separate, respective acoustic signals into separate, respective portions of the viscous medium within the jetting device.

According to some example embodiments, a method for controlling a jetting of one or more droplets of a viscous medium through an outlet of a nozzle may include controlling a viscous medium supply and controlling an acoustic transducer. Controlling the viscous medium supply may include causing the viscous medium supply to induce a flow of the viscous medium through a viscous medium conduit to the outlet of the nozzle. Controlling the acoustic transducer may include causing the acoustic transducer to adjust one or more rheological properties of at least a portion of viscous medium that is located within the viscous medium conduit, based on acoustic actuation of the portion of the viscous medium.

The adjusting one or more rheological properties of at least the portion of the viscous medium includes at least one of inducing increased homogeneity of a spacing of particles in at least the portion of the viscous medium, inducing oscillatory break-up of one or more agglomerations of particles in at least the portion of the viscous medium, reducing a viscosity of a carrier fluid in at least the portion of the viscous medium based on inducing shear-thinning, and inducing a reduction in a volume fraction in at least the portion of the viscous medium.

Controlling the acoustic transducer may include commanding the acoustic transducer to emit the acoustic signal for a particular, limited period of time.

Controlling the acoustic transducer may include commanding the acoustic transducer to emit the acoustic signal based on the viscous medium supply being controlled to induce the flow of the viscous medium.

The viscous medium conduit may at least partially define an eject chamber in fluid communication with the outlet of the nozzle. The eject chamber may be configured to receive a portion of an actuator to move viscous medium located within the eject chamber through the outlet of the nozzle. The controlling the acoustic transducer may include commanding the acoustic transducer to emit the acoustic signal based on the actuator being controlled to extend into the eject chamber.

The acoustic transducer may include a plurality of acoustic transducers. Each acoustic transducer may be configured to emit an acoustic signal that transfers acoustic waves into a separate portion of the viscous medium conduit. Controlling the acoustic transducer may include separately and independently commanding the separate, respective acoustic transducers of the plurality of acoustic transducers to emit separate, respective acoustic signals that transfer acoustic waves into separate, respective portions of the viscous medium within the viscous medium conduit.

According to some example embodiments, a device configured to jet one or more droplets of a viscous medium may include a nozzle, a viscous medium conduit, and an actuator. The nozzle includes an outlet. The nozzle may be configured to jet the one or more droplets through the outlet of the nozzle. The viscous medium conduit may be configured to direct a flow of the viscous medium to the outlet of the nozzle. The viscous medium conduit may at least partially define an eject chamber in fluid communication with the outlet of the nozzle. The actuator may be configured to be actuated, such that the actuator moves through at least a portion of the eject chamber to cause at least a portion of the viscous medium to be jetted through the outlet of the nozzle as the one or more droplets. The actuator may be further configured to be actuated to emit an acoustic signal that transfers acoustic waves into at least a portion of the viscous medium located in the eject chamber.

The device may include a control device that may be configured to control the actuator to cause the one or more droplets to be jetted and to emit the acoustic signal.

The actuator may be configured to be controlled to simultaneously cause at least the portion of the viscous medium to be jetted through the outlet of the nozzle and emit the acoustic signal.

The actuator may be configured to cause one or more droplets to be jetted based on being controlled according to an actuator control signal. The actuator may be further configured to emit the acoustic signal based on being controlled according to an acoustic control signal. The control device may be configured to combine the actuator control signal sequence and the acoustic control signal sequence to establish a combined control signal. The control device may be further configured to control the actuator according to the combined control signal.

BRIEF DESCRIPTION OF THE DRAWINGS

Some example embodiments will be described with regard to the drawings. The drawings described herein are for illustration purposes only and are not intended to limit the scope of the present disclosure in any way.

DETAILED DESCRIPTION

Figure 1:
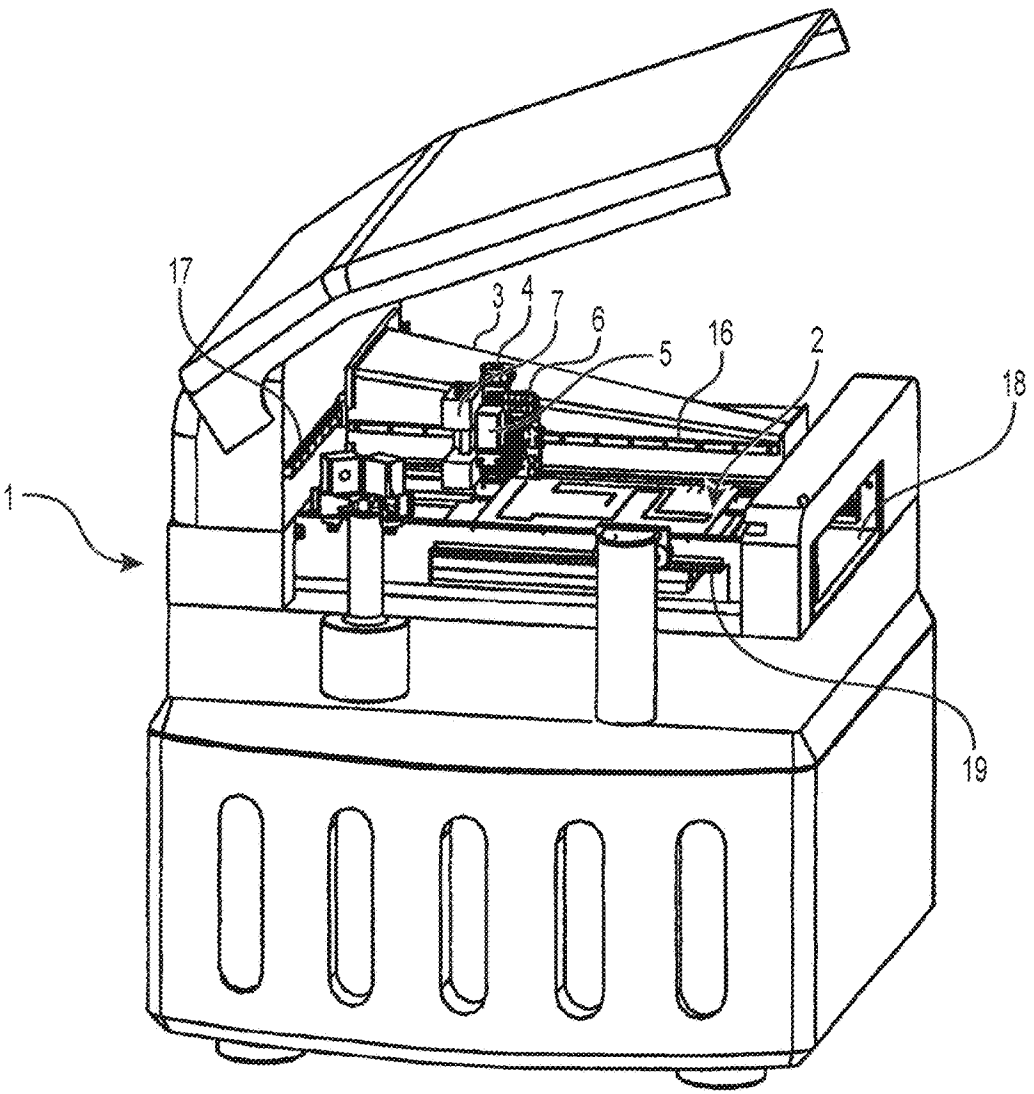
FIG. 1 is a perspective view illustrating a jetting device 1 according to some example embodiments of the technology disclosed herein.

Example embodiments will now be described more fully with reference to the accompanying drawings, in which some example embodiments are shown. In the drawings, the thicknesses of layers and regions are exaggerated for clarity. Like reference numerals in the drawings denote like elements.

Detailed illustrative embodiments are disclosed herein. However, specific structural and functional details disclosed herein are merely representative for purposes of describing example embodiments. Example embodiments may be embodied in many alternate forms and should not be construed as limited to only the example embodiments set forth herein.

It should be understood, that there is no intent to limit example embodiments to the particular ones disclosed, but on the contrary example embodiments are to cover all modifications, equivalents, and alternatives falling within the appropriate scope. Like numbers refer to like elements throughout the description of the figures.

Example embodiments of the technology disclosed herein are provided so that this disclosure will be thorough, and will fully convey the scope to those who are skilled in the art. Numerous specific details are set forth such as examples of specific components, devices, and methods, to provide a thorough understanding of implementations of the technology disclosed herein. It will be apparent to those skilled in the art that specific details need not be employed, that example embodiments of the technology disclosed herein may be embodied in many different forms and that neither should be construed to limit the scope of the disclosure. In some example embodiments of the technology disclosed herein, well-known processes, well-known device structures, and well-known technologies are not described in detail.

The terminology used herein is for the purpose of describing particular example embodiments of the technology disclosed herein only and is not intended to be limiting. As used herein, the singular forms "a", "an" and "the" may be intended to include the plural forms as well, unless the context clearly indicates otherwise. The terms "comprises," "comprising," "includes," "including," "has," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, regions, layers and/or sections should not be limited by these terms. These terms may be only used to distinguish one element, component, region, layer and/or section from another region, layer and/or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments of the technology disclosed herein.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As discussed herein, "viscous medium" may be solder paste, flux, adhesive, conductive adhesive, or any other kind ("type") of medium used for fastening components on a substrate, conductive ink, resistive paste, or the like. However, example embodiments of the technology disclosed herein should not be limited to only these examples.

A "substrate" may be a board (e.g., a printed circuit board (PCB) and/or a flexible PCB), a substrate for ball grid arrays (BGA), chip scale packages (CSP), quad flat packages (QFP), wafers, flip-chips, or the like.

It is also to be noted that the term "jetting" should be interpreted as a non-contact dispensing process that utilizes a fluid jet to form and shoot one or more droplets of a viscous medium from a jet nozzle onto a substrate, as compared to a contact dispensing process, such as "fluid wetting."

The term "gaseous flow" should be interpreted as a flow of air, compressed air, gas of any suitable type, such as nitrogen, or any other medium of a gaseous type.

The term "deposit" may refer to a connected amount of viscous medium applied at a position on a workpiece as a result of one or more jetted droplets.

For some example embodiments, the solder paste may include between about 40% and about 60% by volume of solder balls and the rest of the volume is solder flux.

In some example embodiments, the volume percent of solder balls of average size may be in the range of between about 5% and about 40% of the entire volume of solid phase material within the solder paste. In some example embodiments, the average diameter of the first fraction of solder balls may be within the range of between about 2 and about 5 microns, while the average diameter of a second fraction of solder balls may be between about 10 and about 30 microns.

The term "deposit size" refers to the area on the workpiece, such as a substrate, that a deposit will cover. An increase in the droplet volume generally results in an increase in the deposit height as well as the deposit size.

In the context of the present application, it is to be noted that the term "viscous medium" should be understood as solder paste, solder flux, adhesive, conductive adhesive, or any other kind of medium of fluid used for fastening components on a substrate, conductive ink, resistive paste, or the like, and that the term "jetted droplet", or "shot" should be understood as the volume of the viscous medium that is forced through the jetting nozzle and moving towards the substrate in response to an impact of the impacting device. The jetted droplet may also include a cluster of droplets jetted due to an impact of the impacting device. It is also to be noted that the term "deposit", or a volume of "deposited medium", refers to a connected amount of viscous medium applied at a position on a substrate as a result of one or more jetted droplets, and that the term "substrate" should be interpreted as a printed wiring board (PWD), a printed circuit board (PCB), a substrate for ball grid arrays (BGAs), chip scale packages (CSP), quad flat packages (QFP), wafers, flip-chips, or the like.

It is also to be noted that the term "jetting" should be interpreted as a non-contact dispensing process that utilises a fluid jet to form and shoot droplets of a viscous medium from a jetting nozzle onto a substrate, as to compare to a contact dispensing process, such as "fluid wetting".

In certain aspects of the technology disclosed, the device performing the method defined by the claims is a software controlled ejector. The software needs instructions for how to apply the viscous medium to a specific substrate or according to a predetermined jetting schedule or jetting process. These instructions are called a "jetting program". Thus, the jetting program supports the process of jetting droplets of viscous medium onto the substrate, which process also may be referred to as "jetting process" or "printing process". The jetting program may be generated by a pre-processing step performed off-line, prior to the jetting process.

Thus, the generation of the jetting program involves importing, to a generation program, substrate data relating to a unique or predetermined substrate, or a unique or predetermined set of identical substrates; and defining, on basis of the substrate data, where on the substrate the droplets are to be jetted. In other words, viscous medium is arranged to be jetted onto the substrate according to a predetermined jetting program.

As an example, a computer program is used for importing and processing CAD data or the like about a substrate. The CAD data may e.g. comprise data representing position and extension of contact pads, as well as data representing position, name, and leads of each individual component that is to be mounted on the substrate. The program can be used to determine where on the substrate the droplets are to be jetted, such that each component is provided with deposits having the required volume, lateral extension, and/or height. This is a process which requires knowledge of the size and volume of a single droplet, how many droplets that will be sufficient for covering the needs of a specific component, and where on the substrate each droplet should be placed.

When all droplet configurations for all components have been programmed, a jetting path template may be generated, which describes how the jetting nozzle is going to be moved, e.g. by a jetting machine operating one or more ejectors, in order to jet the droplets of viscous medium onto the substrate. It is understood that the ejectors may operate concurrently or consecutively. The jetting path template is transferred to the jetting program which is used for running the jetting machine, and hence the ejector(s), accordingly. The jetting program may also comprise jetting parameters, e.g. for controlling the feeding of the viscous medium into the nozzle space, and for controlling the impact of the impacting device, in order to provide the substrate with the required deposits.

The pre-processing step that generates the jetting program may involve some manual steps performed by an operator. This may e.g. involve importing the CAD data and determining where on a pad the droplets should be positioned for a specific component. It will however be realized that the preprocessing may be performed automatically by e.g. a computer.

In some example embodiments of the technology disclosed herein, a jetting device that is configured to jet one or more droplets of a viscous medium on to a substrate and includes a nozzle including an outlet, the nozzle configured to jet the one or more droplets through the outlet, and further includes a viscous medium conduit configured to direct a flow of the viscous medium to the outlet of the nozzle, may further include an acoustic transducer configured to emit acoustic signals that transfer acoustic waves to at least a portion of the viscous medium conduit. The acoustic transducer may be configured to emit an acoustic signal into viscous medium located within the portion of the viscous medium conduit, where such viscous medium into which the acoustic signal is emitted may be a portion of the viscous medium in the viscous medium conduit.

In some example embodiments, the acoustic signal is an ultrasonic signal (e.g., an acoustic signal having a frequency greater than 20,000 hertz), such that the acoustic transducer that is configured to emit the ultrasonic signal may be referred to as an "ultrasonic transducer." However, it will be understood that the acoustic transducer, as described herein, is not limited to generating acoustic signals that are ultrasonic signals. For example, an acoustic transducer as described herein may be configured to generate acoustic signals having a frequency between 20 hertz and 20,000 hertz. In another example, an acoustic transducer as described herein may be configured to generate acoustic signals having a frequency that is less than 20 hertz (e.g., infrasonic signals), such that the acoustic transducer may be referred to as an infrasonic transducer.

Based on the emission of an acoustic signal from the acoustic transducer into a portion of the viscous medium, one or more rheological properties of at least the portion of the viscous medium may be adjusted. Such adjustment may result in increased homogeneity in the rheological properties of the viscous medium being directed as a flow through the jetting device and/or being jetted on to the substrate.

For example, where the viscous medium includes one or more types of particles suspended in a carrier fluid, increased homogeneity of the viscous medium may include at least one of increased homogeneity of spacing between the particles in the viscous medium and/or reduced volume viscosity ("bulk viscosity") of the carrier fluid. Such increased homogeneity of spacing may be induced in the viscous medium based on acoustic actuation of the viscous medium, where such acoustic actuation is induced by an acoustic signal that is emitted into the viscous medium from an acoustic transducer.

In some example embodiments, viscosity of a portion of the viscous medium may be adjusted (e.g., caused to be reduced or caused to be increased), such that the viscosity of the portion of the viscous medium has increased similarity with the viscosity of a remainder of the viscous medium, a target viscosity, some combination thereof, or the like. For example, where the viscous medium includes a carrier fluid in which one or more particles are suspended, a volume viscosity ("bulk viscosity") of the viscous medium and/or carrier fluid may be reduced or increased ("adjusted") based on acoustic actuation of at least the carrier fluid. Such acoustic actuation of the carrier fluid may induce shear-thinning of at least the carrier fluid, which may thereby result in a reduction in the bulk viscosity of the carrier fluid and/or viscous medium in general. In another example, where the viscous medium includes a homogenous fluid, including a Non-Newtonian fluid, the acoustic signals emitted by an acoustic transducer may cause shear-thinning of the homogenous fluid, which may result in a reduced viscosity of the viscous medium.

In some example embodiments, where the viscous medium includes a carrier fluid in which one or more particles are suspended, an acoustic signal emitted by an acoustic transducer may cause the oscillatory break-up of one or more agglomerations of particles in the viscous medium, thereby promoting increased homogeneity of particle spacing throughout the viscous medium, where such spacing may result in increased rheological homogeneity of the viscous medium.

Based on adjusting the rheological properties of one or more portions of the viscous medium, the acoustic transducer may induce localized and temporally synchronized fluid properties of the viscous medium. Such fluid property synchronization may enable improved flow and/or pumping of the viscous medium through the jetting device.

In some example embodiments, including where the viscous medium includes a suspension, an acoustic signal emitted by an acoustic transducer may induce the ordered movement of particles in the suspension. The acoustic signal may induce the formation of a depletion area in the volume of the viscous medium, where the volume fraction associated with the depletion area is lower than in the immediate proximity.

In some example embodiments, acoustic signals emitted by an acoustic transducer into a viscous medium may locally change the rheological properties of a portion of a viscous medium to enable a changed volumetric flow and/or mass flow of the viscous medium.

In some example embodiments, acoustic signals emitted by an acoustic transducer into a flow of viscous medium may "prime" the rheological properties of the viscous medium in order to maintain uniform or substantially uniform (e.g., uniform within material tolerances) rheological properties even after a pause in a pumping of the flow, which could otherwise change the rheological properties due to the thixotropic properties of the viscous medium.

In some example embodiments, acoustic signals emitted into a portion of viscous medium that is proximate to the outlet of the nozzle of the jetting device may enable improved control over the breaking of a droplet of viscous medium from the nozzle. Acoustic signals emitted into the viscous medium may induce localized rheological perturbations within the viscous medium to induce controlled spatial break-off localization of a droplet. Acoustic actuation of the viscous medium may induce a particular desired (and/or alternatively, predetermined) spacing of particles in the viscous medium in order to cause a droplet of the viscous medium to break from the nozzle at a particular break-off point.

As a result, unintended variations in droplet properties, and thus the properties of deposits (e.g., one or more of deposit size, deposit placement, deposit shape, etc.) on the substrate, may be reduced.

Unintended variation in one or more of deposit size, deposit placement, deposit shape, etc. on a substrate may be based at least in part upon variations in fluid properties (also referred to herein as rheological properties) of the viscous medium being directed through the jetting device and/or being jetted from the jetting device as one or more droplets.

For example, during a jetting operation, including a jetting operation that includes jetting multiple discrete sets ("strips") of droplets on a substrate, a flow of viscous medium may be caused to flow intermittently, and/or in discrete time increments through at least a portion of the jetting device between the jetting of separate, individual droplets and between the jetting of separate strips of droplets.

In some cases, the rheological properties of one or more portions of the viscous medium in the jetting device may become adjusted based at least in part upon the intermittent flow. For example, agglomerations of particles may form in one or more portions of the viscous medium in the jetting device. In another example, homogeneity of particle spacing in one or more portions of the viscous medium may become reduced.

Such adjustments of rheological properties may be at least partially localized to limited portions of the viscous medium in the jetting device, such that the viscous medium being directed through the jetting device as a flow and/or being jetted from the jetting device as one or more droplets has reduced rheological homogeneity.

Such reduced rheological homogeneity of the viscous medium may lead to variations in the properties of droplets of the viscous medium that are jetted by the jetting device during jetting operations. For example, where a portion of the viscous medium flow that is proximate to a nozzle of the jetting device has a relatively greater viscosity than other portions of the viscous medium flow, a first droplet in a jetting operation, formed based on the jetting of the first portion of the viscous medium flow through the nozzle, may have one or more properties (e.g., size, shape, etc.) that depart from intended properties of the droplet and may further have different properties than subsequently-jetted droplets.

Thus, as a result of such variation in droplet properties that may result from reduced rheological homogeneity of the viscous medium in the jetting device, unintended variations in properties of deposits on the workpiece may occur, which may result in reduced performance, reliability, etc. of the workpiece.

In addition, reduced rheological homogeneity of the viscous medium may adversely affect operation of one or more portions of the jetting device itself. For example, portions of the viscous medium having particle agglomerations may reduce viscous medium flow pathways in one or more portions of the viscous medium conduit through the jetting device. In addition, a viscous medium having reduced rheological homogeneity may cause damage to one or more portions of the jetting device, including the actuator that causes viscous medium to be jetted, the viscous medium supply (including one or more motors, one or more pressurized reservoirs, some combination thereof, or the like) that may induce the flow of viscous medium through the jetting device, some combination thereof, or the like. Such adverse effect inflicted upon the jetting device itself may lead to inflicted undesired operator interventions to resolve such adverse effects, which brings about interruptions in the manufacturing process and thereby decreases the overall manufacturing speed. In some cases, damage incurred by a jetting device due to reduced rheological homogeneity of viscous medium therein may require repair and or replacement of the jetting device, thereby affecting capital and/or maintenance costs.

In some example embodiments of the technology described herein, a jetting device that includes an acoustic transducer configured to be in direct fluid communication with at least a portion of the viscous medium conduit and further configured to emit an acoustic signal into at least a portion of the viscous medium within the portion of the viscous medium conduit may enable reduced unintended variations in one or more properties of deposits on a workpiece, based on adjusting one or more rheological properties of at least a portion of the viscous medium located in and/or flowing through at least the portion of the viscous medium conduit. As a result, Rheological properties of a portion of viscous medium may be controlled based on a relatively quick (e.g., on the order of microseconds) actuation ("activation and/or deactivation") of one or more acoustic transducers.

An acoustic transducer may be controlled based on a control signal that is common with the piezo actuation system ("actuator") that controls the ejection ("jetting") of droplets. In some example embodiments, the timing of the control of the viscous medium rheological properties via acoustic transducer control may be based on and/or synchronized with the actuation timing signal (e.g., "actuator control signal") that is transmitted to the actuator to cause the actuator to cause one or more droplets to be jetted from the jetting outlet. The timing of the acoustic transducer control signals can be configured to cause one or more acoustic transducers to be actuated on a strip-to-strip basis or a drop-to-drop basis. The magnitude of the change in one or more rheological properties (e.g., viscosity) of at least a portion of the viscous medium may be controlled based on controlling one or more acoustic transducers.

In some example embodiments, an acoustic transducer may be controlled based on a control signal that is common with the viscous medium supply that controls the inducement and/or maintenance of a flow of viscous medium to the nozzle of the jetting device to be jetted. In some example embodiments, the timing of the control of the viscous medium rheological properties via acoustic transducer control may be based on and/or synchronized with the flow timing signal (e.g., "flow control signal") that is transmitted to at least a portion of the viscous medium supply (e.g., a motor, a pressurized supply) to cause the viscous medium supply to induce and/or maintain the flow of viscous medium through a viscous medium conduit to the nozzle of the jetting device. For example, the viscous medium supply may include a motor that is configured to induce a flow of viscous medium based on inducing a pressure gradient. In another example, the viscous medium supply may include a pressurized supply that is configured to induce the flow of viscous medium based on releasing a pressurized fluid (e.g., pressurized viscous medium, a pressurized liquid, a pressurized gas, some combination thereof, or the like).

In some example embodiments, an acoustic transducer may be controlled to continuously emit acoustic signals for at least a period of time. The acoustic transducer may thus be controlled to have a continuous effect upon one or more rheological properties of viscous medium located in and/or flow through a particular portion of the viscous medium conduit with which the acoustic transducer is in direct fluid communication.

In some example embodiments, a jetting device that includes an acoustic transducer as described above may further include one or more flow sensors configured to measure a flow (e.g., volumetric flow rate, mass flow rate, and/or flow velocity) of viscous medium within at least a portion of the viscous medium conduit of the jetting device. A control device may control one or more acoustic transducers in the jetting device based on flow data generated by the flow sensors, such that the control device is configured to control the acoustic transducers, using feedback control enabled by the flow sensors, to control the flow of viscous medium. Such control of the acoustic transducers based on flow data generated by a flow sensor may enable improved control of uniform or substantially uniform (e.g., uniform within manufacturing tolerance and/or material tolerances) flow of viscous medium throughout one or more portions of a jetting operation. Such uniform or substantially uniform viscous medium flow may enable improved uniformity in droplets jetted during a jetting operation.

In some example embodiments, a jetting device that includes at least one acoustic transducer, where the acoustic transducer is configured to emit acoustic signals that transfer acoustic waves to at least a portion of a viscous medium conduit that is configured to direct a flow of the viscous medium to the outlet of the nozzle to be jetted, may be configured to provide improved overall operation of the jetting device in relation to jetting devices that are configured to jet droplets of viscous medium on to a substrate and in which such acoustic transducers are absent. A jetting device that includes the above-noted acoustic transducer may jet droplets having an increased rheological homogeneity throughout the jetting operation, thereby jetting droplets having a reduced unintended variation (e.g., improved uniformity) in droplet properties, relative to droplets jetted from a jetting device that jets droplets on a substrate and in which the above-noted acoustic transducer is absent. In addition, by improving droplet uniformity (e.g., reducing unintended droplet variations), the jetting device may be configured to provide improved repeatability of jetting operations and improved positioning accuracy with regards to deposits formed on a substrate based on jetting droplets on to the substrate, relative to a jetting device that jets droplets on a substrate and in which the above-noted acoustic transducer is absent.

In addition, a jetting device that includes the above-noted acoustic transducer may be configured to provide improved uniformity of deposits on a workpiece, relative to devices that transfer ink directly to a printing medium from an ink-bearing medium that is in contact with the printing medium, at least because the jetting device that includes the above-noted acoustic transducer is configured to form deposits on a substrate (e.g., workpiece) using a flow of viscous medium that may be jetted on to the substrate. Furthermore, unlike a device that uses acoustic transducers to cause ink to be transferred from an ink-bearing medium to a contacting printing medium, a jetting device that includes the above-noted acoustic transducer may enable control over the rheological properties, and thus rheological uniformity, of each individual jetted droplet, thereby enabling control over the properties of each individual deposit on the substrate.

As a result of the advantages noted above, a jetting device that includes one or more of the acoustic transducers as described above may be configured to form deposits on a workpiece to form a board, where the deposits have reduced unintended variation (e.g., improved uniformity, improved repeatability, improved reliability, etc.) in size, form, and/or position based on improved control over the rheological properties of the droplets as enabled by the one or more acoustic transducers. The board may therefore have reduced susceptibility to errors (e.g., short-circuits across deposits) that may otherwise result from unintended variation in deposits on the board. Thus, a jetting device that includes the one or more acoustic transducers as described above may at least partially mitigate and/or solve the problem of reduced reliability, performance, and/or lifetime of boards generated via deposits formed on a workpiece via jetting one or more strips of droplets, where the reduced reliability is based on unintended variations in position, form and/or size of the deposits caused by rheological variation across the droplets jetted on the workpiece, as the jetting device is configured to provide droplets having increased rheological homogeneity and thus reduced unintended variation in droplet properties throughout a jetting operation.

In some example embodiments, a jetting device that includes at least one acoustic transducer, where the at least one acoustic transducer is configured to emit acoustic signals that transfer acoustic waves to at least a portion of the viscous medium conduit that is configured to direct a flow of the viscous medium to the outlet of the nozzle to be jetted, may be configured to improve overall operation of the jetting device in relation to jetting devices in which such acoustic transducers are absent. A jetting device that includes the above-noted acoustic transducer may be configured to reduce the occurrence of a rheologically heterogeneous flow of viscous medium (e.g., improve the rheological homogeneity and/or uniformity of the viscous medium flowing through the viscous medium conduit), where a rheologically heterogeneous flow of viscous medium may otherwise adversely affect and/or damage the jetting device itself, via one or more of high-viscosity portions of the viscous medium at least partially obstructing a viscous medium conduit, high-viscosity portions of the viscous medium adversely affecting the ability of moving parts of the jetting device to move along the entirety of the configured movement range of the moving parts, some combination thereof, or the like. As a result, a jetting device that includes one or more of the acoustic transducers as described above may be configured to perform jetting operations with and reduced and/or minimized occurrence of operation interruptions and/or jetting device maintenance events, thereby improving the speed and/or efficiency of manufacturing operations involving the jetting device, relative to jetting devices in which the one or more acoustic transducers as described above are absent. In addition, and for similar reasons, the operating life of a jetting device that includes the at least one acoustic transducer may be extended in relation to jetting devices in which said acoustic transducers are absent.

As a result of the advantages noted above, a jetting device that includes one or more of the acoustic transducers may be configured to at least partially mitigate and/or solve a problem of board-fabrication efficiency, jetting device maintenance costs, and/or jetting device replacement costs that may result from rheologically heterogeneous flows of viscous medium in a jetting device during jetting operations.

In some example embodiments, a jetting device that includes at least one acoustic transducer, where the at least one acoustic transducer is configured to emit acoustic signals that transfer acoustic waves to at least a portion of the viscous medium conduit that is configured to direct a flow of the viscous medium to the outlet of the nozzle to be jetted, may be configured to provide may be configured to enable improved control of the size (volume and/or mass) and/or positioning of individual droplets that are jetted from the nozzle on to a workpiece, relative to jetting devices in which the at least one acoustic transducer is absent. The improved control over rheological properties of individual portions of viscous medium in the jetting device, including rheological properties of a local viscous medium that may at least partially comprise a droplet and/or a filament connecting the droplet to the nozzle, may enable control over the spatial and/or temporal localization (e.g., position and/or timing, respectively) of the break-off of an individual droplet and/or individual droplet filament from the nozzle of the jetting device based on controlling the rheological properties of the local viscous medium through acoustic actuation in relation to individual shots and/or strips of jetted droplets during a jetting operation. As a result, a jetting device that includes the at acoustic transducer, based on being configured to enable such improved droplet break-off control, may be configured to jet droplets with improved uniformity with regard to the timing and/or position of the break-off of each individual droplet from the nozzle, relative to droplets jetted from a jetting device in which the at least one acoustic transducer is absent. Such improved droplet break-off uniformity may enable a jetting device that includes the at least one acoustic transducer to jet droplets having reduced variation (e.g., improved uniformity) in size, shape, and/or position on a workpiece, relative to droplets jetted from a jetting device in which the at least one acoustic transducer is absent.

As a result of the advantages noted above, a jetting device that includes the at least one acoustic transducer may be configured to jet droplets with improved individual control and improved uniformity. The jetted droplets may form deposits on a workpiece to form a board, where the deposits have reduced unintended variation (e.g., improved uniformity, improved repeatability, improved reliability, etc.) in size, form, and/or position based on the improved droplet break-off control enabled by the at least one acoustic transducer. The board may therefore have reduced susceptibility to errors (e.g., short-circuits across deposits) that may otherwise result from unintended variation in deposits on the board. Thus, a jetting device that includes the at least one acoustic transducer may at least partially mitigate and/or solve the problem of reduced reliability, performance, and/or lifetime of boards generated via deposits formed on a workpiece via jetting one or more strips of droplets, where the reduced reliability is based on spatial and/or temporal variations in droplet break-off across various droplets jetted during a jetting operation.

As referred to herein, "filament break-off," "break-off of a filament," and the like, and "droplet break-off," "break-off of a droplet," and the like may be used interchangeably.

FIG. 1 is a perspective view illustrating a jetting device 1 according to some example embodiments of the technology disclosed herein.

The jetting device 1 may be configured to dispense ("jet") one or more droplets of a viscous medium onto a substrate 2 to generate ("establish," "form," "provide," etc.) a substrate 2 having one or more deposits therein. The above "dispensing" process performed by the jetting device 1 may be referred to as "jetting."

For ease of description, the viscous medium may hereinafter be referred to as solder paste, which is one of the alternatives defined above. For the same reason, the substrate may be referred to herein as an electric circuit board and the gas may be referred to herein as air.

In some example embodiments, including the example embodiments illustrated in FIG. 1, the jetting device 1 includes an X-beam 3 and an X-wagon 4. The X-wagon 4 may be connected to the X-beam 3 via an X-rail 16 and may be reciprocatingly movable (e.g., configured to be moved reciprocatingly) along the X-rail 16. The X-beam 3 may be reciprocatingly movably connected to a Y-rail 17, the X-beam 3 thereby being movable (e.g., configured to be moved) perpendicularly to the X-rail 16. The Y-rail 17 may be rigidly mounted in the jetting device 1. Generally, the above-described movable elements may be configured to be moved based on operation of one or more linear motors (not shown) that may be included in the jetting device 1.

In some example embodiments, including the example embodiments illustrated in FIG. 1, the jetting device 1 includes a conveyor 18 configured to carry the board 2 through the jetting device 1, and a locking device 19 for locking the board 2 when jetting is to take place.

A docking device 8 may be connected to the X-wagon 4 to enable releasable mounting of an assembly 5 at the docking device 8. The assembly 5 may be arranged for dispensing droplets of solder paste, i.e. jetting, which impact and form deposits on the board 2. The jetting device 1 also may include a vision device 7. In some example embodiments, including the example embodiments illustrated in FIG. 1, the vision device is a camera. The camera 7 may be used by a control device (not shown in FIG. 1) of the jetting device 1 to determine the position and/or rotation of the board 2 and/or to check the result of the dispensing process by viewing the deposits on the board 2.

In some example embodiments, including the example embodiments illustrated in FIG. 1, the jetting device 1 includes a flow generator 6. In some example embodiments, including the example embodiments illustrated in FIG. 1, the flow generator 6 is a vacuum ejector (also referred to herein as a "vacuum pump") that is arranged ("located," "positioned," etc.) on the X-wagon 4, and a source of compressed air (not shown). The flow generator 6, as well as the source of compressed air, may be in communication with the docking device 8 via an air conduit interface which may be connectable to a complementary air conduit interface. In some example embodiments, the air conduit interface may include input nipples 9 of the docking device 8, as shown in FIG. 2.

As understood by those skilled in the art, the jetting device 1 may include a control device (not explicitly shown in FIG. 1) configured to execute software running the jetting device 1. Such a control device may include a memory storing a program of instructions thereon and a processor configured to execute the program of instructions to operate and/or control one or more portions of the jetting device 1 to perform a "jetting" operation.

In some example embodiments, the jetting device 1 may be configured to operate as follows. The board 2 may be fed into the jetting device 1 via the conveyor 18, upon which the board 2 may be placed. If and/or when the board 2 is in a particular position under the X-wagon 4, the board 2 may be fixed with the aid of the locking device 19. By means of the camera 7, fiducial markers may be located, which markers are prearranged on the surface of the board 2 and used to determine the precise position thereof. Then, by moving the X-wagon over the board 2 according to a particular (or, alternatively, predetermined, pre-programmed, etc.) pattern and operating the jetting assembly 5 at predetermined locations, solder paste is applied on the board 2 at the desired locations. Such an operation may be at least partially implemented by the control device that controls one or more portions of the jetting device 1 (e.g., locating the fiducial markers via processing images captured by the camera 7, controlling a motor to cause the X-wagon to be moved over the board 2 according to a particular pattern, operating the jetting assembly 5, etc.).

Figure 2:
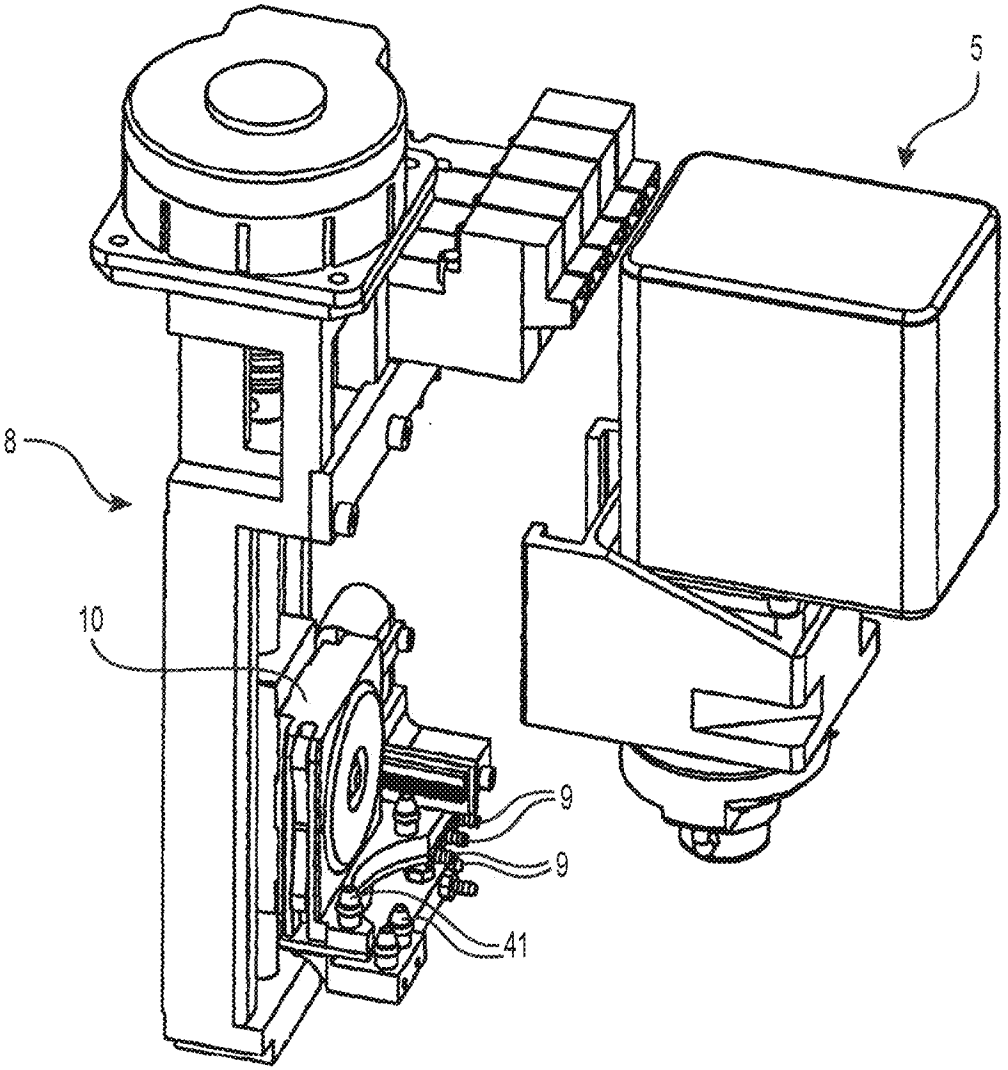
FIG. 2 is a schematic view illustrating a docking device and a jetting assembly according to some example embodiments of the technology disclosed herein.
Figure 3:
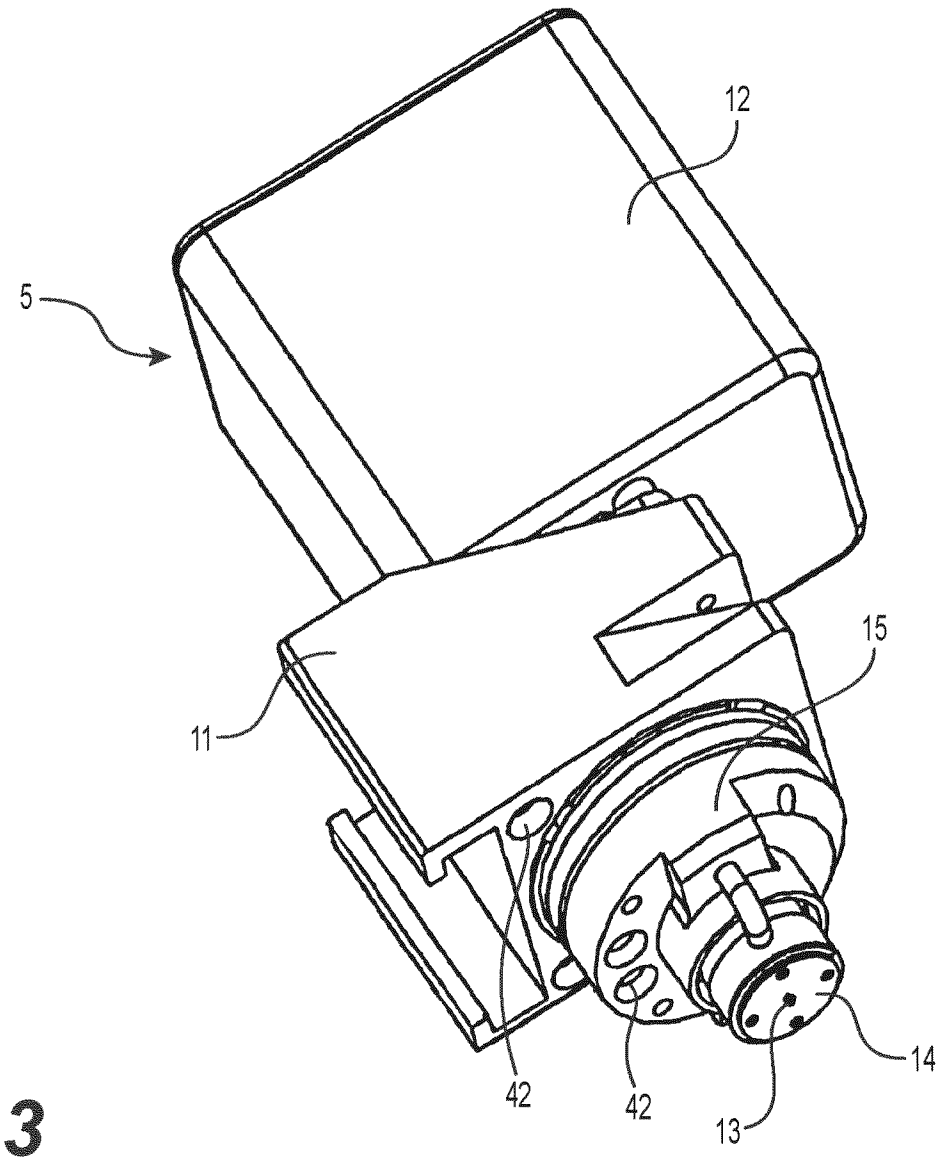
FIG. 3 is a schematic view illustrating a jetting assembly according to some example embodiments of the technology disclosed herein.

FIG. 2 is a schematic view illustrating a docking device 8 and a jetting assembly 5 according to some example embodiments of the technology disclosed herein. FIG. 3 is a schematic view illustrating a jetting assembly 5 according to some example embodiments of the technology disclosed herein. The docking device 8 and jetting assembly 5 may be included in one or more example embodiments of a jetting device 1, including the jetting device 1 illustrated in FIG. 1.

In some example embodiments, including the example embodiments illustrated in FIGS. 2-3, a jetting assembly 5 may include an assembly holder 11 configured to connect the jetting assembly 5 to an assembly support 10 of the docking device 8. Further, in some example embodiments, the jetting assembly 5 may include a supply container 12 configured to provide a supply of solder paste, and an assembly housing 15. The jetting assembly 5 may be connected to the flow generator 6 and the source of pressurized air via a pneumatic interface comprising inlets 42, positioned (e.g., "configured") to interface in airtight engagement with a complementary pneumatic interface comprising outlets 41, of the docking device 8.

Figure 4A:
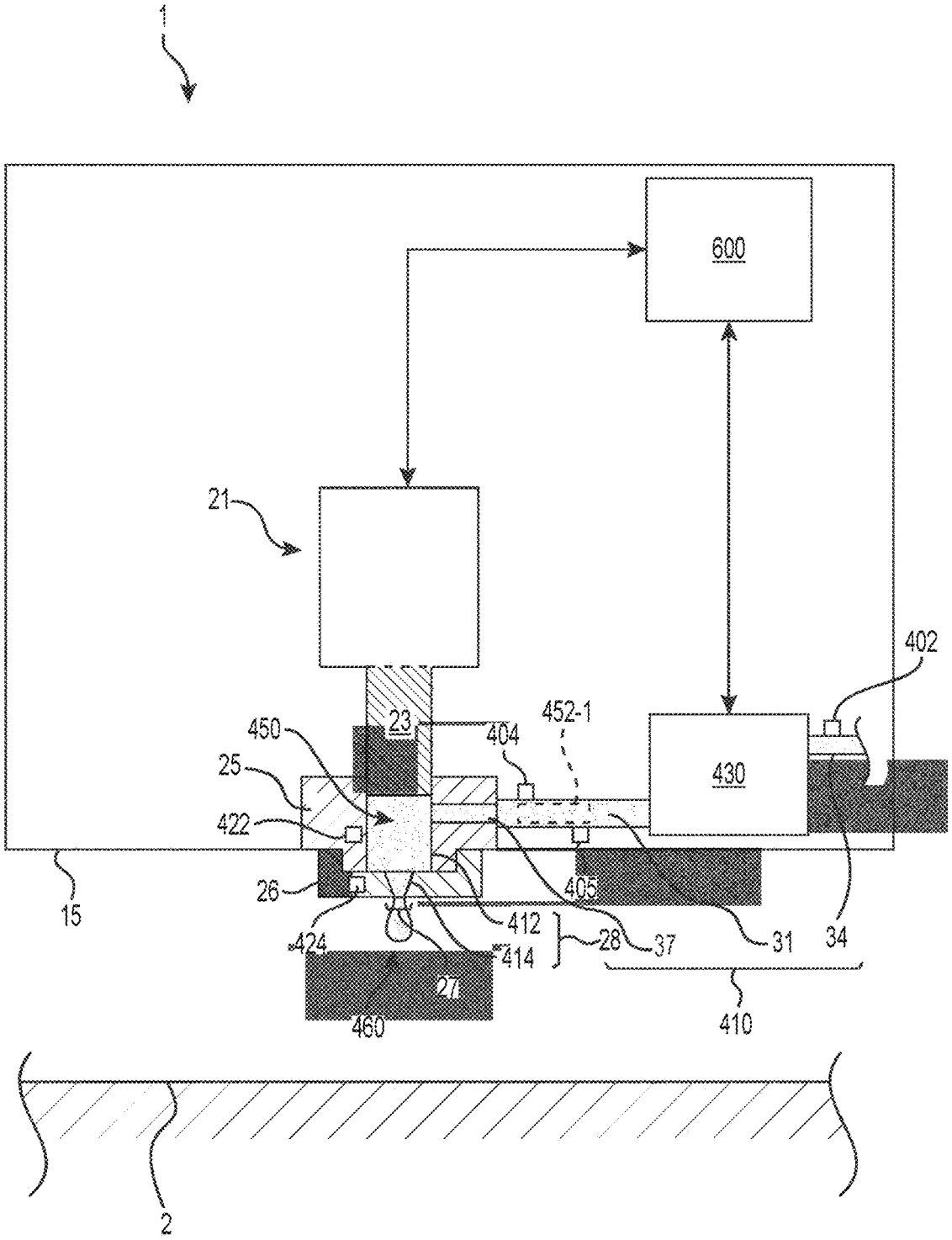
FIG. 4A is a sectional view of a portion of a jetting device according to some example embodiments of the technology disclosed herein.
Figure 4B:
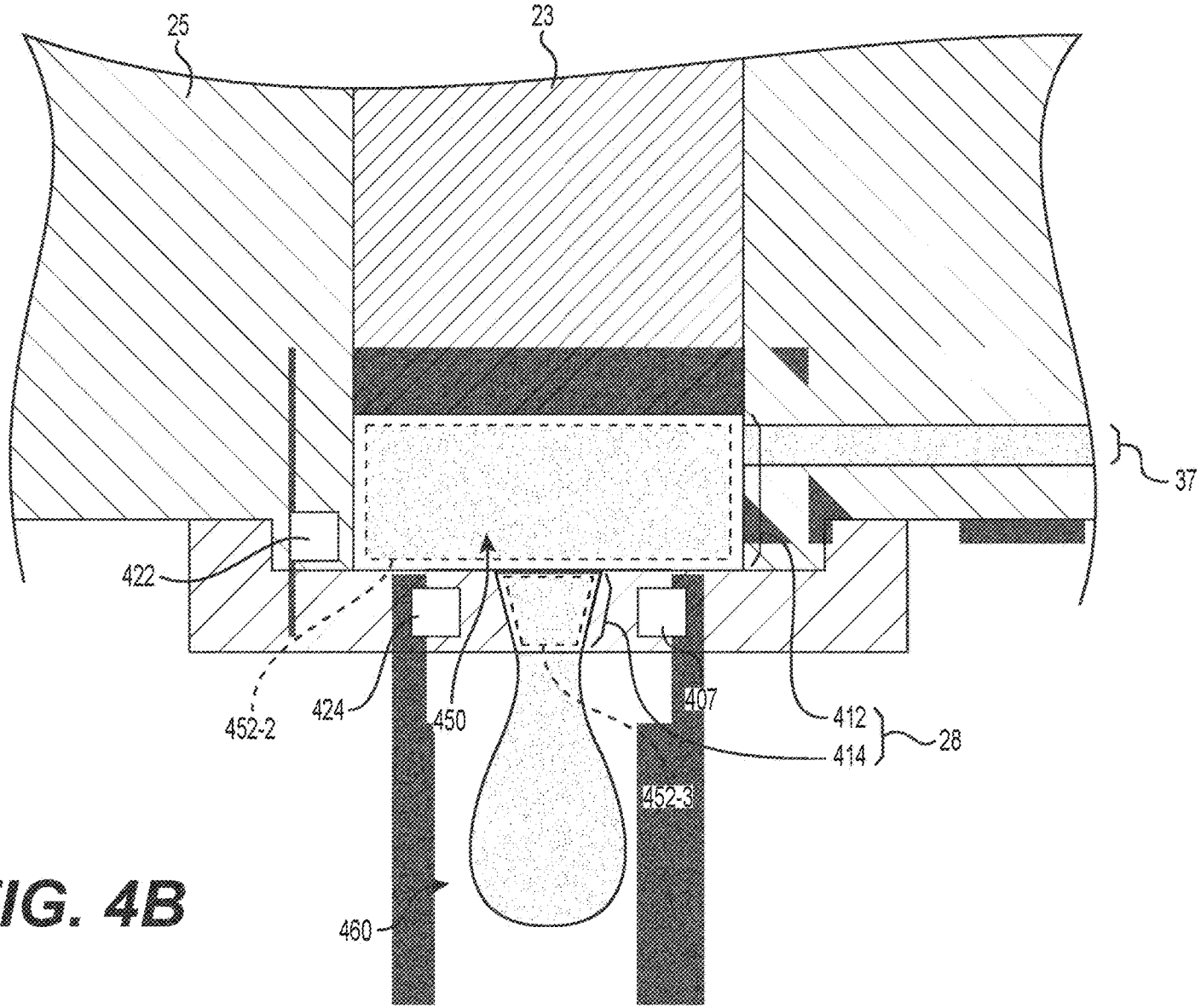
FIG. 4B is a sectional view of a portion of the jetting device illustrated in FIG. 4A according to some example embodiments of the technology disclosed herein.
Figure 4C:
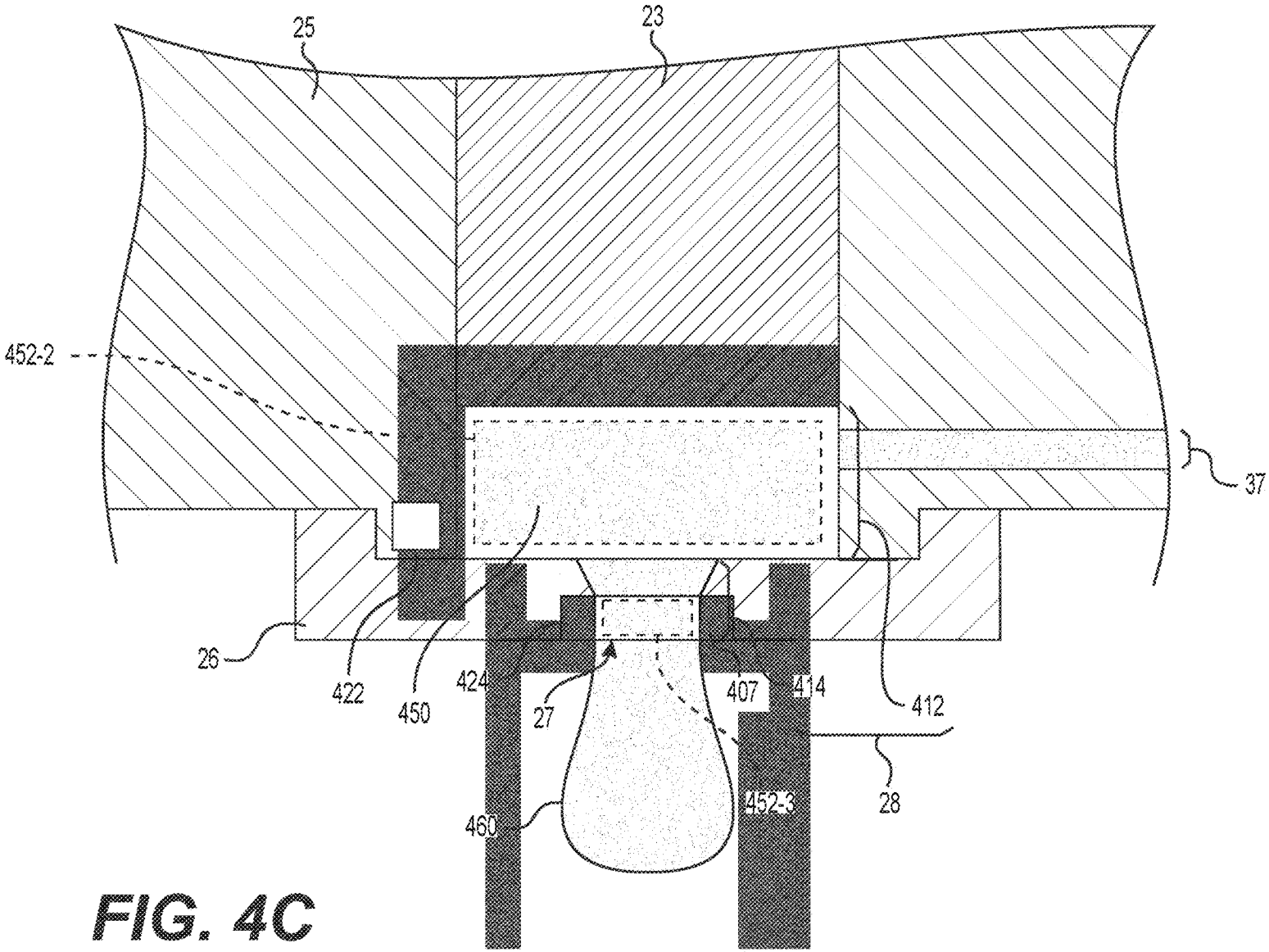
FIG. 4C is a sectional view of a portion of the jetting device illustrated in FIG. 4B according to some example embodiments of the technology disclosed herein.

FIG. 4A is a sectional view of a portion of a jetting device 1 according to some example embodiments of the technology disclosed herein. FIG. 4B is a sectional view of a portion of the jetting device illustrated in FIG. 4A according to some example embodiments of the technology disclosed herein. FIG. 4C is a sectional view of a portion of the jetting device illustrated in FIG. 4B according to some example embodiments of the technology disclosed herein.

With reference now to FIGS. 4A-4C, the contents and function of the device enclosed in the assembly housing will be explained in greater detail. In some example embodiments, the jetting device 1 may include an actuator locking screw for supporting an actuator in the assembly housing 15, and a piezoelectric actuator 21 (also referred to herein as simply an "actuator 21") formed by (e.g., at least partially comprising") a number ("quantity") of thin, piezoelectric elements stacked together to form ("at least partially comprise") the actuator 21. The actuator 21 may be rigidly connected to the locking screw.

In some example embodiments, including the example embodiments illustrated in FIGS. 4A-4C, the jetting device 1 further includes a bushing 25 rigidly connected to the assembly housing 15, and a plunger 23 rigidly connected to the end of the actuator 21. The plunger 23 and bushing 25 may be opposite the position of the locking screw. The plunger 23 is axially movable while slidably extending through a bore in the bushing 25. The jetting device 1 may include cup springs that are configured to resiliently balance the plunger 23 against the assembly housing 15, and to provide a preload for the actuator 21.

In some example embodiments, the jetting device 1 includes a control device 600. The control device 600 may be configured to apply a drive voltage intermittently to the piezoelectric actuator 21, thereby causing an intermittent extension thereof and hence a reciprocating movement of the plunger 23 with respect to the assembly housing 15, in accordance with solder pattern printing data. Such data may be stored in a memory included in the control device 600. The drive voltage may be described further herein as including and/or being included in a "control signal," including an "actuator control signal."

In some example embodiments, including the example embodiments illustrated in FIG. 4A-4C, the jetting device 1 includes an eject nozzle 26 (also referred to herein as "nozzle 26") configured to be operatively directed against the board 2 (also referred to herein as a substrate and/or a workpiece), onto which one or more droplets 460 of solder paste ("viscous medium 450") may be jetted. The nozzle 26 may include a jetting orifice 27 (also referred to herein as an outlet 27 of the nozzle 26, a nozzle outlet 27, or the like) through which the droplets 460 may be jetted. The surfaces of the nozzle 26 surrounding the jetting orifice 27 and facing the substrate 2 (e.g., the bottom surfaces of the nozzle 26 surrounding the jetting orifice in the example embodiments illustrated in FIGS. 4A-4C) will be referred to herein as a jetting outlet. The plunger 23 comprises a piston portion which is configured to be slidably and axially movably extended through a piston bore, an end surface of said piston portion of the plunger 23 being arranged close to said nozzle 26.

An eject chamber 28 is defined by the shape of the end surface of said plunger 23, the inner diameter of the bushing 25 and the nozzle orifice 27. A portion of the eject chamber 28 that is defined by the shape of the end surface of the plunger 23, the inner diameter of the bushing 25, and an upper surface of the nozzle 26 may be referred to herein as an internal cavity 412. A portion of the eject chamber 28 that is defined by an inner surface of a conduit extending through the nozzle may be referred to herein as a nozzle cavity 414. As shown in FIGS. 4A-4B, the nozzle cavity 414 may have a volumetric shape approximating that of a truncated conical space. As shown in FIG. 4C, the nozzle cavity 414 may have a volumetric shape approximating that of a truncated conical space and an adjacent cylindrical space. Example embodiments of the nozzle cavity 414 are not limited to the example embodiments shown in FIGS. 4A-4C.

Axial movement of the plunger 23 towards the nozzle 26, said movement being caused by the intermittent extension of the piezoelectric actuator 21, said movement involving the plunger 23 being received at least partially or entirely into the volume of the internal cavity 412, will cause a rapid decrease in the volume of the eject chamber 28 and thus a rapid pressurization and jetting through the nozzle orifice 27, of any viscous medium 450 contained in the eject chamber 28, including the movement of any viscous medium 450 contained in the internal cavity 412 out of the internal cavity 412 and through the nozzle cavity 414 to the outlet 27 to form one or more droplets 460.

Viscous medium 450 may be supplied to the eject chamber 28 from a supply container via a feeding device. The feeding device may be referred to herein as a viscous medium supply 430. The viscous medium supply 430 may be configured to induce a flow of viscous medium 450 (e.g., "solder paste") through one or more conduits to the nozzle 26. The viscous medium supply 430 may include a motor (which is not shown and may be an electric motor) having a motor shaft partly provided in a tubular bore, which extends through the assembly housing 15 to an outlet communicating via a conduit 31 with a piston bore. In another example embodiment, the viscous medium supply 430 may include a pressurized supply configured to induce a flow of viscous medium through the tubular bore based on releasing a pressurized fluid from a pressurized reservoir. An end portion of the motor shaft may form a rotatable feed screw which is provided in, and coaxial with, the tubular bore. A portion of the rotatable feed screw may be surrounded by an array of resilient, elastomeric a-rings arranged coaxially therewith in the tubular bore, the threads of the rotatable feed screw making sliding contact with the innermost surface of the a-rings.

The pressurized air obtained from the above-mentioned source of pressurized air (not shown) may apply a pressure on the viscous medium 450 contained in the supply container, thereby feeding said viscous medium 450 to an inlet port 34 communicating with the conduit 34 and further in fluid communication with the viscous medium supply 430.

An electronic control signal provided by the control device 600 of the jetting device 1 to the viscous medium supply 430 may cause a motor shaft of the viscous medium supply 430, and thus the rotatable feed screw, to rotate a desired angle, or at a desired rotational speed. Viscous medium 450 captured between the threads of the rotatable feed screw and the inner surface of the a-rings may then be caused to travel from the inlet port 34 to the eject chamber 28 via conduit 31, in accordance with the rotational movement of the motor shaft. A sealing a-ring may be provided at the top of the piston bore and the bushing 25, such that any viscous medium 450 fed towards the piston bore is prevented from escaping from the piston bore and possibly disturbing the action of the plunger 23.

The viscous medium 450 is then fed into the eject chamber 28 via the conduit 31 and a channel 37. As shown in FIGS. 4A-4C, the channel 37 may extend through the bushing 25 to the eject chamber 28 through a sidewall of the eject chamber 28. As shown in FIGS. 4A-4C, the channel 37 has a first end in fluid communication with the conduit 31 and a second end in fluid communication with the eject chamber 28 through a sidewall of the eject chamber 28 (e.g., the sidewall of the internal cavity 412 as shown in FIGS. 4A-4C).

As described herein, one or more of the inlet port 34, tubular bore, conduit 31, channel 37, and eject chamber 28 (which may include internal cavity 412 and/or nozzle cavity 414) may comprise, in part or in full, a viscous medium conduit 410 that is configured to direct a flow of the viscous medium ("solder paste") to the outlet 27 of the nozzle 26.

As shown in FIGS. 4A-4C, at least a portion of the viscous medium conduit 410 may encompass at least a portion of the viscous medium supply 430. For example, a tubular bore may encompass the motor shaft of a motor comprising the viscous medium supply 430. In another example, at least a portion of the viscous medium conduit 410 may define the eject chamber 28. In some example embodiments, at least a portion of the viscous medium conduit 410 may at least partially encompass the actuator 21 (e.g., may at least partially encompass the plunger 23).

In some example embodiments, including the example embodiments illustrated in at least FIG. 4B, the jetting device 1 includes a support plate located below or downstream of the nozzle orifice 27, as seen in the jetting direction. The support plate is provided with a through hole, through which the jetted droplets 460 may pass without being hindered or negatively affected by the support plate. Consequently, the hole is concentric with the nozzle orifice 27.

In some example embodiments, including the example embodiments illustrated in at least FIGS. 4A-4C, the jetting device 1 includes one or more acoustic transducers. Each acoustic transducer may be configured to emit acoustic signals that transfer acoustic waves to at least a portion of the viscous medium conduit 410. Each acoustic transducer may be configured to emit an acoustic signal into viscous medium 450 located within the portion of the viscous medium conduit 410. As shown in FIG. 4B, in some example embodiments, one or more acoustic transducers may be isolated from being in direct fluid communication with at least a portion of the viscous medium 450 that is located at and/or is flowing through the viscous medium conduit 410. Such one or more acoustic transducers, as shown in FIG. 4B, may be configured to emit acoustic signals that propagate through at least a portion of the jetting device (e.g., at least a portion of the assembly housing 15 and/or the nozzle 26) to reach at least a portion of the viscous medium conduit 410, such that the acoustic signals transfer acoustic waves into at least a portion of the viscous medium 450 in the viscous medium conduit. As shown in FIG. 4B-4C, in some example embodiments, each acoustic transducer may be configured to be in direct fluid communication with at least a portion of the viscous medium 450 that is located at and/or is flowing through the portion of the viscous medium conduit 410 at which the respective acoustic transducer is located.

As shown in FIG. 4A, acoustic transducer 404 is configured to emit acoustic signals that transfer acoustic waves to conduit 31 and is configured to be in direct fluid communication with a local viscous medium 452-1, of the viscous medium 450 in the viscous medium conduit 410, that is located within a portion of the conduit 31 that is within a particular threshold proximity to the acoustic transducer 404. In some example embodiments, acoustic transducer 404 may be may be isolated from being in direct fluid communication with local viscous medium 452-1 and may be configured to emit acoustic signals that propagate through at least a portion of the jetting device (e.g., at least a portion of the assembly housing 15) to reach, and transfer acoustic waves into, at least the local viscous medium 452-1 in conduit 31.

In another example, as shown in FIGS. 4B-4C, acoustic transducer 422 is configured to emit acoustic signals that transfer acoustic waves to internal cavity 412 and is configured to emit acoustic signals that transfer acoustic waves to a local viscous medium 452-2, of the viscous medium 450 in the viscous medium conduit 410, that is located within a portion of the internal cavity 412 that is within a particular threshold proximity to the acoustic transducer 422. As shown in FIGS. 4B-4C, the acoustic transducer 422 may be isolated from direct fluid communication with the local viscous medium 452-2, such that the acoustic transducer 422 is configured to emit acoustic signals that propagate through at least a portion of the bushing 25 to reach the internal cavity 412 and the local viscous medium 452-2. In some example embodiments, acoustic transducer 422 may be at an inner surface at least partially defining internal cavity 412, such that the acoustic transducer 422 is in direct fluid communication with local viscous medium 452-2.

In another example, as shown in FIGS. 4B-4C, acoustic transducer 424 is configured to emit acoustic signals that transfer acoustic waves to nozzle cavity 414 and is configured to emit acoustic signals that transfer acoustic waves to a local viscous medium 452-3, of the viscous medium 450 in the viscous medium conduit 410, that is located within a portion of the nozzle cavity 414 that is within a particular threshold proximity to the acoustic transducer 424. As shown in FIG. 4B, the acoustic transducer 424 may be isolated from direct fluid communication with the local viscous medium 452-3, such that the acoustic transducer 424 is configured to emit acoustic signals that propagate through at least a portion of the nozzle 26 to reach the nozzle cavity 414 and the local viscous medium 452-3. As shown in FIG. 4C, in some example embodiments, acoustic transducer 424 may be at an inner surface at least partially defining nozzle cavity 424, such that the acoustic transducer 424 is in direct fluid communication with local viscous medium 452-3. As shown in FIG. 4C, the acoustic transducer 424 may be configured to emit acoustic signals that transfer acoustic waves to a local viscous medium 452-3 that is in a limited portion of the nozzle cavity 414.

In some example embodiments, each acoustic transducer is configured to emit an acoustic signal that transfers acoustic waves into at least the portion of viscous medium 450 that is located at and/or is flowing through the portion of the viscous medium conduit 410 proximate to the respective acoustic transducer and/or at which the respective acoustic transducer is located, such that the acoustic transducer causes at least one rheological property of the portion of viscous medium 450 (e.g., a local viscous medium 452) to be adjusted based on acoustic actuation. One or more of the acoustic transducers may be controlled by one or more control devices 600, at least partially collectively and/or independently, to control the flow of viscous medium at least partially through the jetting device 1 and/or to control one or more properties of droplets 460 jetted by the jetting device 1 during a jetting operation.

As described further below, the example embodiments of the jetting device 1 as shown in FIGS. 4A-4C include multiple acoustic transducers. However, it will be understood that a jetting device 1 according to some example embodiments may include an individual one of the acoustic transducers shown in FIGS. 4A-4C, a limited selection of the acoustic transducers shown in FIGS. 4A-4C, one or more acoustic transducers located at different positions within the jetting device 1 in relation to the positions shown in FIGS. 4A-4B, some combination thereof, or the like.

Referring first to FIG. 4B and FIG. 4C, in some example embodiments, the viscous medium conduit 410 at least partially defines the eject chamber 28 which includes a nozzle cavity 414 that is in fluid communication with the outlet of the nozzle 26. As further shown in FIG. 4B and FIG. 4C, the jetting device 1 may include an acoustic transducer 424 that is configured to emit acoustic signals that transfer acoustic waves to a portion of the viscous medium conduit 410 that defines the nozzle cavity 414. As a result, the acoustic transducer 424 is configured to emit acoustic signals that transfer acoustic waves to a local viscous medium 452-3 that is located in and/or flows through the nozzle cavity 414 during a jetting operation.

In some example embodiments, the acoustic transducer 424 may be controlled to emit acoustic signals that transfer acoustic waves into the viscous medium 450 that is located in and/or flows through the nozzle cavity 414 during a jetting operation. As a result, the acoustic transducer 424 may adjust one or more rheological properties of the viscous medium 450 that is located in and/or flows through the nozzle cavity 414.

In some example embodiments, based on emitting acoustic signals that transfer acoustic waves into the viscous medium 450 to adjust one or more rheological properties thereof, the acoustic transducer 424 may thus enable control of the flow of viscous medium 450 through the nozzle cavity 414 and further through the outlet 27 of the nozzle 26 to form one or more droplets 460, such that the flow remains uniform or substantially uniform throughout a jetting operation.

In some example embodiments, based on emitting acoustic signals that transfer acoustic waves into the viscous medium 450 to adjust one or more rheological properties thereof, the acoustic transducer 424 may thus enable control of the break-off of one or more droplets 460 of viscous medium 450 from the nozzle 26 through the outlet 27.

Still referring to FIGS. 4A-4C, in some example embodiments, the viscous medium conduit 410 at least partially defines an internal cavity 412 in fluid communication with the outlet 27 of the nozzle 26 through the nozzle cavity 414. As shown in FIGS. 4A-4C, the internal cavity 412 may be configured to receive a portion of an actuator 21, including plunger 23, to move a portion of the flow of viscous medium 450 that is located within the internal cavity 412 through the outlet 27 of the nozzle 26, such that the portion of the flow of viscous medium 450 is at least partially jetted from the jetting device 1.

In some example embodiment, including the example embodiments shown in FIG. 4B and FIG. 4C, an acoustic transducer 422 is configured to emit acoustic signals that transfer acoustic waves through the bushing 25 that at least partially defines the internal cavity 412 of the viscous medium conduit 410. As a result, the acoustic transducer 422 may be configured to emit acoustic signals that propagate through the bushing 25 and transfer acoustic waves to a portion of the flow of viscous medium 450 that is located within and/or flows through the internal cavity 412 (e.g., local viscous medium 452-2). In some example embodiments, the acoustic transducer 422 may be in direct fluid communication with the internal cavity 412 and may be configured to emit an acoustic signal directly into the portion of the viscous medium 450 that is located in and/or is flowing through the internal cavity 412 (e.g., the local viscous medium 452-2 with regard to the acoustic transducer 422).

In some example embodiments, based on emitting acoustic signals that transfer acoustic waves into the viscous medium 450 to adjust one or more rheological properties thereof, the acoustic transducer 422 may thus enable control of the flow of viscous medium 450 through at least the eject chamber 28 (e.g., at least through the internal cavity 412) and further through the outlet 27 of the nozzle 26, such that the flow remains uniform or substantially uniform throughout a jetting operation.

In some example embodiments, one or more of the acoustic transducers 422 and 424 may be controlled based on and/or in synchronization with the actuator 21 causing viscous medium 450 to be moved through the eject chamber 28 and out of the nozzle 26 to be jetted as one or more droplets 460. For example, one or more of the transducers 422 and 424 may be controlled ("actuated") to emit acoustic signals beginning at a particular period of time before the actuator 21 moves the plunger 23 to move viscous medium out of the internal cavity 412, such that the flow of viscous medium 450 through the eject chamber 28 is maintained at a particular, uniform or substantially uniform flow. In another example, acoustic transducer 424 may be controlled ("actuated") to emit acoustic signals to control the break-off of a droplet 460 from the nozzle 26 at a particular amount of elapsed time after the actuator 21 is controlled to cause viscous medium 450 to be jetted out of the nozzle 26.

As described further below, one or more of the acoustic transducers 422, 424 may be controlled based at least in part upon flow data generated by a flow sensor that is configured to generate sensor data associated with at least a portion of the viscous medium located at and/or flowing through the viscous medium conduit 410.

Referring back to FIG. 4A, in some example embodiments, a jetting device 1 may include one or more acoustic transducers that are configured to emit acoustic signals that transfer acoustic waves to at least a portion of the viscous medium supply, such that the one or more acoustic transducers are located proximate to one or more separate portions of the viscous medium conduit 410 that at least partially encompass a the viscous medium supply.

For example, as shown in FIG. 4A, the jetting device 1 may include at least one of acoustic transducer 402 and acoustic transducer 404. As shown, acoustic transducer 402 is located proximate to inlet port 34, and acoustic transducer 404 is configured to emit acoustic signals that transfer acoustic waves to local viscous medium 452-1 in at least a portion of conduit 31. Each of the acoustic transducers 402 and 404 may be controlled to emit acoustic signals that transfer acoustic waves into viscous medium 450 that is flowing into or out of a tubular bore that at least partially encompasses a portion of the viscous medium supply 430, respectively. For example, each of the acoustic transducers 402 and 404 may emit acoustic signals that transfer acoustic waves into viscous medium 450 that is being directly agitated by a motor shaft of the viscous medium supply 430.

Because the acoustic transducers 402 and 404 may emit acoustic signals that transfer acoustic waves into viscous medium 450 that is being directly agitated by the viscous medium supply 430, one or more of the acoustic transducers 402 and 404 may adjust one or more rheological properties of such viscous medium 450 through acoustic actuation, as further described above. Here, such adjustment may improve homogeneity of the flow of viscous medium 450 that is induced by the viscous medium supply 430. Such improved homogeneity of the flow of viscous medium may result in improved flow uniformity of viscous medium 450 in the jetting device 1 during a jetting operation. For example, while the viscous medium supply (e.g., a motor) may operate intermittently during the jetting operation to induce a flow of a viscous medium 450 that includes a Non-Newtonian fluid, the acoustic transducers 402 and 404 may be controlled to enable a uniform or substantially uniform flow of the Non-Newtonian fluid throughout the jetting operation based on adjusting, via acoustic actuation, one or more rheological properties of the local Non-Newtonian fluid (e.g., reducing viscosity) that is flowing and/or is located in direct fluid communication with the viscous medium supply 430.

Referring back to FIGS. 4A-4C, in some example embodiments, a jetting device 1 includes multiple (e.g., a "plurality") of acoustic transducers. Each acoustic transducer of said plurality may be configured to emit acoustic signals that transfer acoustic waves to a separate portion of the viscous medium 450 located in and/or flowing through the viscous medium conduit 410. Each acoustic transducer may be further configured to be separately and independently controlled to emit separate, respective acoustic signals that transfer acoustic waves into separate, respective portions of the viscous medium 450 (e.g., separate, respective instances of local viscous medium 452-1, 452-2, and 452-3) within the viscous medium conduit 410.

For example, referring to FIGS. 4A-4C, a jetting device 1 may include both acoustic transducer 422 and acoustic transducer 424. Each of the acoustic transducers 422 and 424 may be separately and independently controlled, for example to emit acoustic signals at different times in relation to a time at which the actuator 21 is controlled to cause a portion of the viscous medium to be jetted from the outlet 27 of the nozzle 26. For example, if and/or when the actuator 21 is controlled to move the plunger 23 into the internal cavity 412 at a particular time (t=0) to cause at least a portion of the viscous medium 450 in the internal cavity 412 (e.g., local viscous medium 452-2) to be moved through the remainder of the eject chamber 28 and out of the nozzle 26 via the outlet 27, the acoustic transducer 422 may be controlled to emit one or more acoustic signals that transfer acoustic waves into the local viscous medium 452-2 in the internal cavity 412 at a particular time (t=−1) that precedes and/or is simultaneous with the time at which the actuator 21 is controlled (t=0). In addition, the acoustic transducer 424 may be controlled to emit one or more acoustic signals that transfer acoustic waves into the local viscous medium 452-3 located in and/or flowing through the eject chamber 28 at a particular time (t=1) that is simultaneous with and/or post-dates the time at which the actuator 21 is controlled (t=0).

In another example, each of the acoustic transducers 402 and 404 may be separately and independently controlled, for example to emit acoustic signals at different times in relation to a time at which the viscous medium supply 430 is controlled to cause a flow of viscous medium 450 to be induced in the viscous medium conduit 410. For example, if and/or when a viscous medium supply 430 that includes a motor is controlled to induce a flow of viscous medium 450 through the viscous medium conduit 410 at a particular time (t=0), the acoustic transducer 402 may be controlled to emit one or more acoustic signals into the viscous medium 450 located in the inlet port 34 at a particular time (t=−1) that precedes and/or is simultaneous with the time at which the motor is controlled (t=0). In addition, the acoustic transducer 404 may be controlled to emit one or more acoustic signals into the local viscous medium 452-1 located in and/or flowing through the conduit 31 at a particular time (t=1) that is simultaneous with and/or postdates the time at which the motor is controlled (t=0).

Referring back to FIG. 4A, in some example embodiments, the jetting device 1 includes one or more flow sensors that are configured to measure a local flow (e.g., volumetric flow rate, mass flow rate, flow velocity, etc.) of the viscous medium 450 through one or more portions of the viscous medium conduit 410. For example, as shown in FIG. 4A, the jetting device 1 may include a flow sensor 405 that is located at or proximate to an inner surface of conduit 31, such that the flow sensor 405 is configured to generate flow data indicating a measured flow of viscous medium 450 through the conduit 31. In another example, as shown in FIG. 4C, the jetting device 1 may include a flow sensor 407 that is located at or proximate to an inner surface of nozzle cavity 414, such that the flow sensor 407 is configured to generate flow data indicating a measured flow of viscous medium 450 through the outlet 27 of the nozzle 26.

In some example embodiments, one or more of the acoustic transducers of the jetting device may be controlled based on flow data generated by one or more flow sensors of the jetting device 1, such that the flow of viscous medium 450 through one or more portions of the viscous medium conduit 410 may be maintained at a uniform or substantially-uniform flow based on feedback control of the one or more acoustic transducers.

For example, referring first to FIG. 4A, one or more of the acoustic transducers 402 and 404 may be controlled based on flow data generated by flow sensor 405 to enable a uniform or substantially-uniform flow of viscous medium 450 through conduit 31. In another example, referring to FIG. 4B and FIG. 4C, one or more of the acoustic transducers 422 and 424 may be controlled based on flow data generated by flow sensor 407 to enable a uniform or substantially-uniform flow of viscous medium 450 through the outlet 27 of nozzle 26.

In some example embodiments, including the example embodiments shown in at least FIGS. 4B and 4C, an acoustic transducer (e.g., acoustic transducers 402, 404, 422, and/or 424 in FIGS. 4B-4C) may be isolated from an inner surface of a viscous medium conduit 410. However, it will be understood that an acoustic transducer may be located at any location, with regard to the jetting device 1, wherein the acoustic transducer is configured to emit an acoustic signal that transfers acoustic waves (also referred to as transferring "acoustic energy") into at least a portion of the viscous medium 450 in at least a portion of the viscous medium conduit 410. For example, in some example embodiments, the jetting device may include an acoustic transducer that is isolated from direct contact with the inner surface of the viscous medium conduit 410, such that the acoustic transducer is isolated from direct fluid communication with viscous medium 450 in the viscous medium conduit 410. Such an acoustic transducer may be configured to emit an acoustic signal that propagates through at least a portion of the jetting device 1 (e.g., a portion of the assembly housing 15 of the jetting device) to reach the viscous medium conduit 410 and transfer acoustic waves in the emitted acoustic signal into viscous medium 450 located in the viscous medium conduit 410. In some example embodiments, an acoustic transducer may be located at an outer surface of the jetting device 1. For example, with reference to FIGS. 4A-4C, an acoustic transducer (e.g., acoustic transducer 424) may be located on (e.g., attached to, adhered to, etc.) an outer surface of the jetting device 1 at a location, on an outer surface of the nozzle 26, that is proximate to and/or adjacent to the outlet 27 of the nozzle 26 (e.g., an outer surface of the eject chamber 28, an outer surface of nozzle cavity 414, etc.), such that the acoustic transducer is configured to emit acoustic signals that transfer acoustic waves to at least a portion of the viscous medium 450 in the viscous medium conduit 410 (e.g., viscous medium 452-3 in the nozzle cavity 414).

Figure 5A:
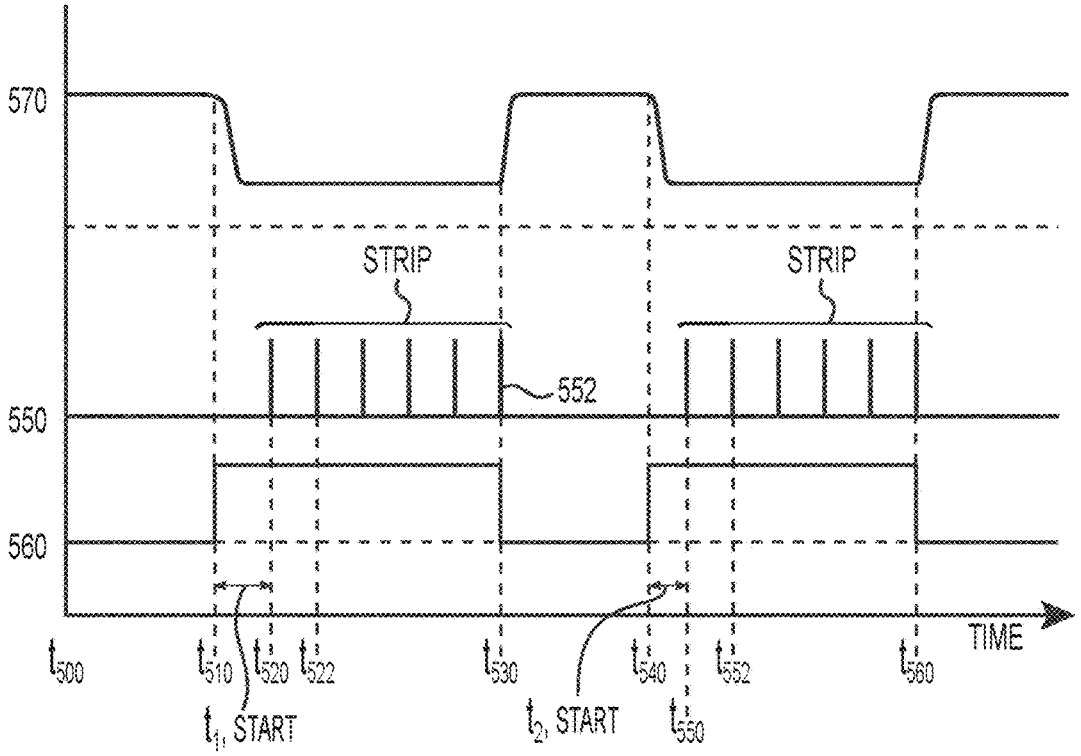
FIG. 5A is a timing chart illustrating control signals transmitted over time to at least some elements of the jetting device illustrated in FIGS. 4A-4B to cause the at least some elements of the jetting device to perform at least one operation according to some example embodiments of the technology disclosed herein.
Figure 5B:
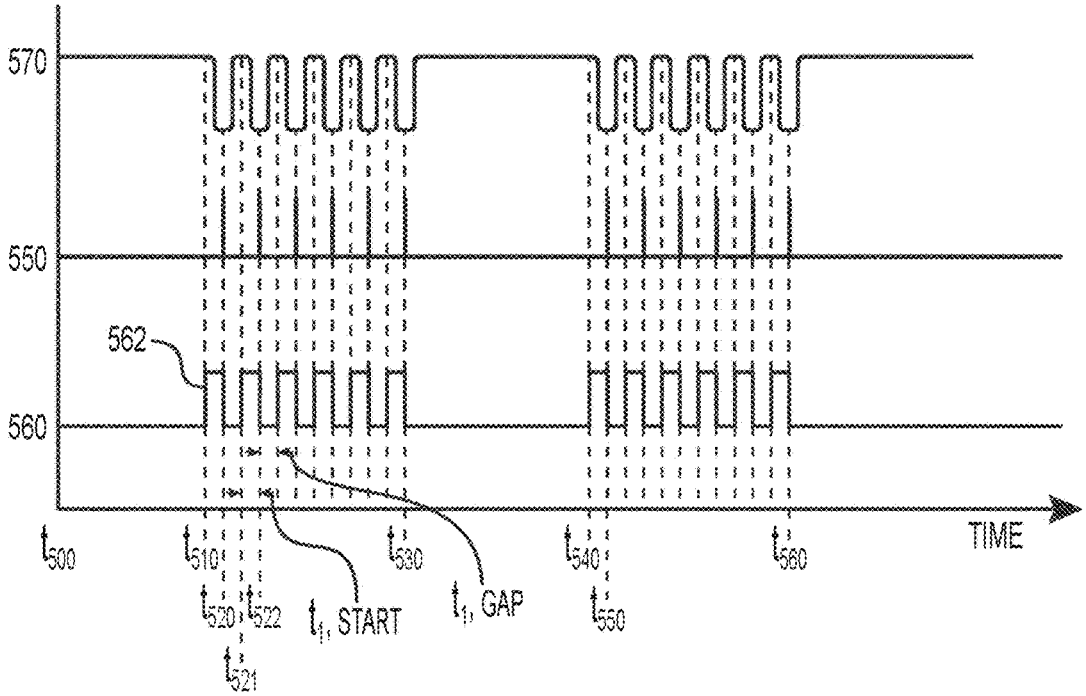
FIG. 5B is a timing chart illustrating control signals transmitted over time to at least some elements of the jetting device illustrated in FIGS. 4A-4B to cause the at least some elements of the jetting device to perform at least one operation according to some example embodiments of the technology disclosed herein.
Figure 5C:
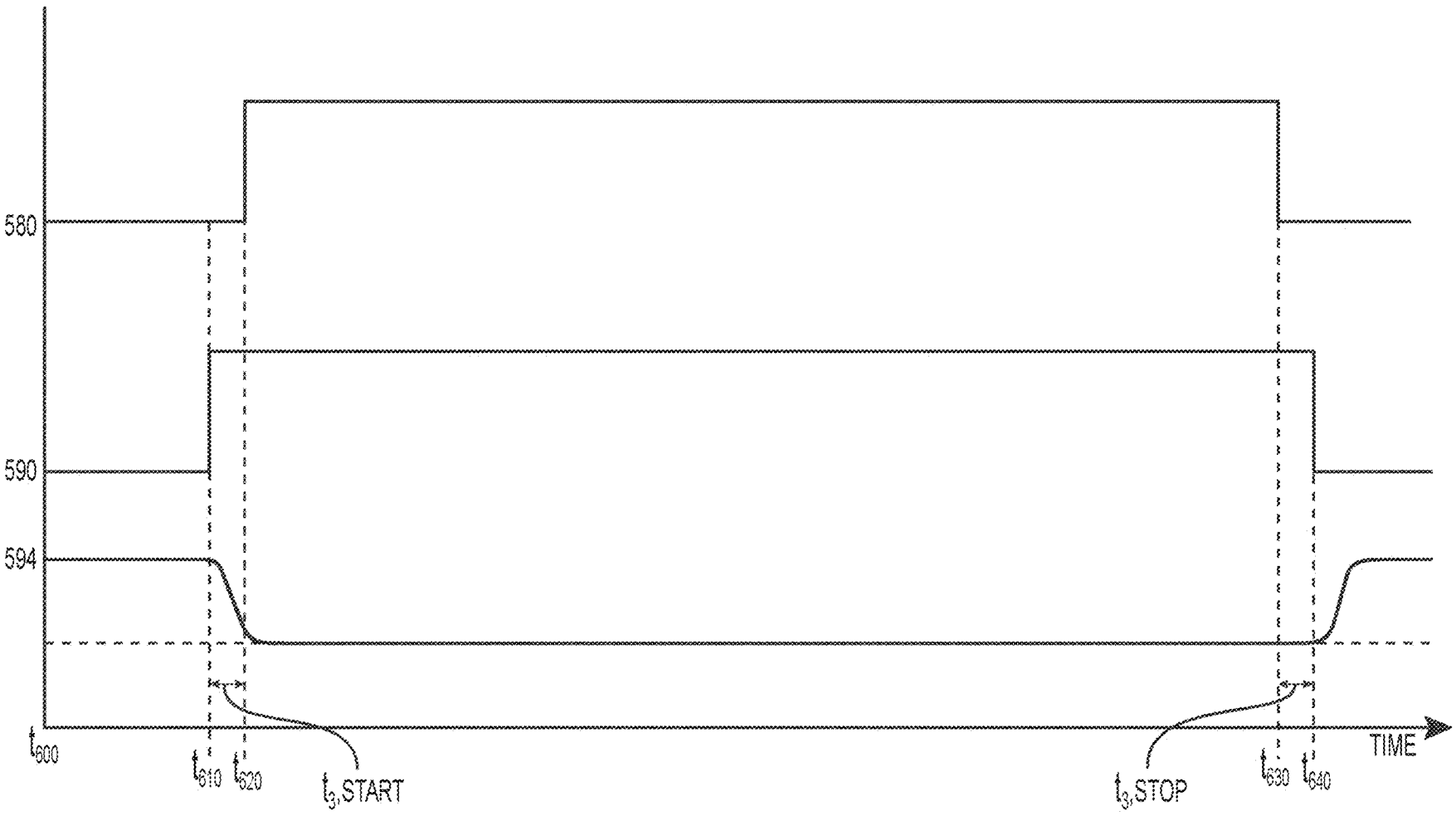
FIG. 5C is a timing chart illustrating control signals transmitted over time to at least some elements of the jetting device illustrated in FIGS. 4A-4B to cause the at least some elements of the jetting device to perform at least one operation according to some example embodiments of the technology disclosed herein.

FIG. 5A is a timing chart illustrating control signals transmitted over time to at least some elements of the jetting device illustrated in FIGS. 4A-4B to cause the at least some elements of the jetting device to perform at least one operation according to some example embodiments of the technology disclosed herein. FIG. 5B is a timing chart illustrating control signals transmitted over time to at least some elements of the jetting device illustrated in FIGS. 4A-4B to cause the at least some elements of the jetting device to perform at least one operation according to some example embodiments of the technology disclosed herein. FIG. 5C is a timing chart illustrating control signals transmitted over time to at least some elements of the jetting device illustrated in FIGS. 4A-4B to cause the at least some elements of the jetting device to perform at least one operation according to some example embodiments of the technology disclosed herein.

As shown in each of FIG. 5A, FIG. 5B, and FIG. 5C, an acoustic transducer may be controlled to emit acoustic signals, and thus adjust at least one rheological property of a local viscous medium, for at least one particular, limited period of time during a jetting operation. As further shown, the acoustic transducer may be controlled based on one or more control signals generated and/or transmitted with regard to one or more other elements of the jetting device 1.

Referring first to FIG. 5A, one or more of the acoustic transducers 402, 404, 422, 424 may be controlled ("actuated") to control one or more rheological properties of at least a portion of the viscous medium 450 located in and/or flowing through the viscous medium conduit 410 during a jetting operation that includes jetting one or more "strips" of droplets on a substrate.

FIG. 5A illustrates a timing chart showing the magnitude and/or timing of various control signals that may be generated and/or transmitted by one or more control devices of the jetting device 1 during a jetting operation. The timing chart illustrated in FIG. 5A further shows a magnitude a rheological property of at least a portion of the viscous medium 450 in the jetting device 1 at different times during the jetting operation and in relation to control signals generated and/or transmitted with regard to the actuator 21 and/or one or more of the acoustic transducers.

As shown, the timing chart of FIG. 5A illustrates a control signal 550 (an "actuator control signal") transmitted to an actuator 21 in the jetting device 1, a control signal 560 ("transducer control signal") transmitted to the one or more acoustic transducers (that may include one or more of the acoustic transducers 402, 404, 422, 404 illustrated in FIGS.

4A-4B), and a rheological property 570 of at least a portion of the viscous medium in the jetting device 1. While control signal 560 is illustrated as a control signal that is generated and/or transmitted for a single, individual acoustic transducer, it will be understood that multiple control signals may be separately and/or independently generated and/or transmitted for separate, respective acoustic transducers in the jetting device 1 during a jetting operation.

Still referring to FIG. 5A, line 570 represents a value of at least one rheological property of at least a portion of a viscous medium 450 in the viscous medium conduit 410. For example, line 570 may represent a magnitude of the viscosity of the portion of viscous medium 450 that is located within the nozzle cavity 414 of the eject chamber 28 (e.g., local viscous medium 452-3 with regard to acoustic transducer 424). In addition, line 560 may represent the control signals generated and/or transmitted to at least the acoustic transducer 424 that is configured to emit acoustic signals that transfer acoustic waves to the viscous medium conduit 410 that at least partially defines the nozzle cavity 414, such that the acoustic transducer 424 is configured to be in direct fluid communication with the portion of viscous medium 450 (e.g., local viscous medium) represented by line 570. Accordingly, as shown in FIG. 5A, at least one rheological property of the viscous medium 450, including viscosity as shown in FIG. 5A, may be adjusted based on a control signal 560 being generated and/or transmitted to the acoustic transducer 424.

As shown in FIG. 5A, in some example embodiments, a jetting operation may include generating and/or transmitting control signal 550 in multiple separate sets of signals, where each set of signal "pulses" 552, where each set of pulses 552 includes a set of sequentially generated/transmitted control signal 550 pulses. Each individual control signal 550 pulse 552 may cause an actuator 21 of the jetting device 1 to jet an individual droplet from the nozzle 26. An individual jetting of an individual droplet may be referred to herein as a "shot," and a set of jettings may be referred to as a "strip." Accordingly, an individual pulse 552 of control signal 550 that corresponds to an individual shot caused by the actuator 21 may be referred to as a "shot pulse" and a set of individual pulses that collectively correspond to a strip of shots may be referred to as a set of "strip pulses."

FIG. 5A illustrates a jetting operation that includes transmitting at least two sets of control signal 550 pulses 552 to cause ("trigger") the actuator 21 of the jetting device 1 to jet at least two separate strips of shots of droplets, where at least the first two strips include at least six (6) shots.

As shown in FIG. 5A, a jetting operation may be initialized at a time ("timestamp") $t_{500}$. At time $t_{520}$, the jetting operation may include jetting a first shot of a first strip, followed at time $t_{522}$ by the remaining five shots of the first strip at one or more intervals of elapsed time, to cause the jetting device 1 to jet a first strip of droplets. To cause the jetting device 1 to perform such a jetting, and as shown in FIG. 5A, a control signal 550 pulse 552 may be generated and/or transmitted sequentially, starting at time $t_{520}$ and at one or more intervals from time $t_{520}$ to time t530 to cause the jetting device 1 to jet the shots of the first strip.

To cause the jetting device 1 to implement a second strip of shots, control signal 550 pulses 552 may be generated sequentially, starting at time t550 and at one or more intervals from time t550 to time $t_{560}$ to cause the jetting device 1 to jet the shots of the second strip. Each separate control signal 550 pulse 552 may cause the actuator 21 of the jetting device 1 to jet an individual droplet from nozzle 26. Such jetting may include the plunger 23 of the actuator 21 being received into the internal cavity 412 to cause the viscous medium 450 located in the internal cavity 412 to be moved through the eject chamber 28 and at least partially jetted from the outlet 27 of the nozzle 26.

As shown in FIG. 5A, in some example embodiments, control signal 560 may be generated and/or transmitted to control at least one acoustic transducer of the jetting device (e.g., acoustic transducer 424), thereby to cause the at least one acoustic transducer to emit an acoustic signal that transfers acoustic waves into a portion of the viscous medium 450 that is located in and/or is flowing through a portion of the viscous medium conduit 410.

As shown in FIG. 5A, in some example embodiments, an acoustic transducer may be controlled to emit acoustic signals during, before, and/or after each separate strip of shots during a given jetting operation to control one or more rheological properties of viscous medium 450 in at least a portion of the viscous medium conduit 410. In some example embodiments, including the example embodiments shown in FIG. 5A, an acoustic transducer may be controlled to emit acoustic signals during separate periods of elapsed time that encompass separate, respective strips of shots. As a result, as shown in FIG. 5A, the acoustic transducer may control one or more rheological properties of at least a portion of the viscous medium 450 in the jetting device during and/or before and/or after separate strips, thereby reducing and/or mitigating the risk of reduced homogeneity in the viscous medium 450 which could lead to unintended variations in jetted droplet 460 parameters.

In some example embodiments, including the example embodiments shown in FIG. 5A, control signal 560 may be generated and/or transmitted continuously from a time starting at time $t_{510}$ that is a particular period of elapsed time $t_{1,start}$ preceding the first shot of the first strip. As a result, during the period of time preceding time $t_{510}$, the acoustic transducer may not emit any acoustic signals, and the acoustic transducer may initiate the emission of acoustic signals at time $t_{510}$.

As shown in FIG. 5A, at time $t_{510}$ that is a particular period of elapsed time $t_{1,start}$ preceding the first shot of the first strip, control signal 560 may be initiated and/or increased in magnitude, which may cause the acoustic transducer to initiate the emission ("transmission") of acoustic signals into at least a portion of viscous medium 450 with which the acoustic transducer is in direct fluid communication.

As shown in FIG. 5A, the control signal 560 may be maintained continuously until the time t530 at which the final control signal 550 pulse 552 corresponding to the final shot of the first strip is generated and/or transmitted. At time t530, the transmitted and/or generated control signal 560 may be inhibited and/or reduced in magnitude, such that the acoustic transducer is caused to cease the emission of acoustic signals.

As shown in FIG. 5A, a rheological property (e.g., viscosity) of at least a portion of viscous medium 450 to which acoustic signals emitted by the acoustic transducer may transfer acoustic waves (e.g., viscous medium 450 in the nozzle cavity 414 if and/or when the acoustic transducer controlled by control signal 560 is acoustic transducer 424), which may be viscosity thereof, is adjusted from a first value to a second, different value from time $t_{510}$ to time t530 based on the acoustic transducer being controlled via control signal 560 to emit acoustic signals during that period of time. For example, as shown in FIG. 5A, a viscosity of at least a portion of viscous medium 450 may be adjusted (e.g., reduced or increased), based on acoustic actuation, from time $t_{510}$ to time t530. As a result, the rheological homogeneity of the viscous medium 450 located throughout the jetting device may be improved, which may lead to improved uniformity of viscous medium 450 flow and droplet 460 properties throughout the jetting operation.

Still referring to FIG. 5A, the control signal 560 may be inhibited for a particular period of time that follows time t530 and ends at a time $t_{540}$ that is a particular amount of elapsed time $t_{2,start}$ prior to a time t550 at which the first shot of the next strip is jetted. Accordingly, as shown in FIG. 5A, the rheological properties of the viscous medium 450 to which acoustic signals emitted by the acoustic transducer may transfer acoustic waves may return to an un-adjusted state similar to the state of the properties prior to time $t_{510}$.

At time $t_{540}$, the control signal 560 is re-started and/or increased in magnitude until the final shot of the second strip at time $t_{560}$. In some example embodiments, the control signal 560 may be maintained in magnitude for at least a particular period of elapsed time after the final shot of a given strip. For example, the control signal 560 may be maintained from time $t_{540}$ until a time that is after time $t_{560}$, such that the acoustic transducer continues to emit acoustic signals, and thus adjust one or more rheological properties of the viscous medium 450 to which acoustic signals emitted by the acoustic transducer may transfer acoustic waves (herein referred to as the "local" viscous medium with regard to the acoustic transducer) for at least the time that is after time $t_{560}$.

As shown in FIG. 5A, an acoustic transducer may be controlled, via control signals 560, such that the acoustic transducer is caused to emit acoustic signals based on and/or in synchronization with the control signals 550 that cause the actuator 21 to jet one or more droplets.

Referring now to FIG. 5B, in some example embodiments, the control signal 560 may be generated and/or transmitted in individual "pulses" 562 that are each based on separate, respective and individual shots of a given strip. As a result, one or more rheological properties of the local viscous medium 450 may be adjusted based on each individual droplet jetting. This may enable increased uniformity in viscous medium 450 flow and/or droplet properties while actuating the acoustic transducer for a reduced cumulative period of time, thereby reducing power requirements associated with the jetting operation.

As shown in FIG. 5B, transmission and/or generation of each control signal 560 pulse 562 may be initiated prior to, and in synchronization with, the generation and/or transmission of an individual control signal 550 pulse 552 corresponding to an individual shot. As shown in FIG. 5B, each pulse 562 of control signal 560 may be maintained for a period of elapsed time $t_{1,START}$ preceding the generation and/or transmission of the control signal 550 pulse 552 corresponding to the given shot, while the control signal 550 pulse may be an "instantaneous" pulse. As also shown in FIG. 5B, the control signal 560 pulse 562 causes a rheological property 570 of the local viscous medium 450 to be pulsed between different values.

In some example embodiments, for example where the acoustic transducer controlled by control signal 560 is the acoustic transducer 424 shown in FIG. 4B, each pulse 562 of control signal 560 may cause the rheological properties of the local viscous medium 450 that is located in and/or flowing through the nozzle cavity 414 to be "pulsed" concurrently or substantially concurrently (e.g., concurrently within manufacturing tolerances and/or material tolerances) with the viscous medium 450 being jetted from the outlet 27 of the nozzle 26 as a droplet 460 as a result of the control signal 550 pulse 552.

As a result, the pulsing of the acoustic transducer to generate an acoustic signal pulse may cause the droplet 460 to break away from the nozzle 26, thereby controlling one or more parameters of the droplet 460, including droplet size, as described further above. As a result, by pulsing the acoustic transducer in synchronization or substantial synchronization (e.g., in synchronization within manufacturing tolerances and/or material tolerances) with each shot of a strip, the jetting device 1 can further control the parameters of an individual droplet 460 by controlling the breaking of the droplet 460 from the nozzle 26.

As a result, the pulsing of control signal 560 to pulse an acoustic transducer in synchronization with each shot may cause the jetting device 1 to generate deposits having reduced unintended variation, thereby improving the reliability of devices formed through forming deposits on the substrate.

In some example embodiments, a timing of the control signal pulse 562 in relation to the control signal 550 pulse 552 corresponding to a jetting of the droplet may be determined and/or adjusted, additionally or in alternative.

In some example embodiments, one or more of the timing, duration, and magnitude of the control signal 560 may be adjusted based on flow data generated by one or more flow sensors included in the jetting device 1, to cause increased uniformity of viscous medium 450 flow through the viscous medium conduit 410, to cause increased uniformity of droplets 460 jetted by the jetting device 1 during a jetting operation, and/or to improve control of droplet 460 properties.

Referring now to FIG. 5C, in some example embodiments, one or more acoustic transducers may be controlled to emit acoustic signals continuously based on a viscous medium supply 430 being controlled to induce a flow of viscous medium 450 through the viscous medium conduit 410. As a result, the acoustic transducer(s) may improve uniformity of the flow based on controlling one or more rheological properties of local viscous medium 450 in the flow.

As shown, the timing chart of FIG. 5C illustrates a control signal 580 (a "supply control signal") transmitted to at least a portion of a viscous medium supply 430 (e.g., a motor) in the jetting device, a control signal 590 ("transducer control signal") transmitted to the one or more acoustic transducers (that may include one or more of the acoustic transducers 402, 404, 422, 404 illustrated in FIGS. 4A-4B), and a rheological property 594 of at least a portion of the viscous medium 450 in the jetting device 1. While control signal 590 is illustrated as a control signal that is generated and/or transmitted for a single, individual acoustic transducer, it will be understood that multiple control signals may be separately and/or independently generated and/or transmitted for separate, respective acoustic transducers in the jetting device 1 during a jetting operation.

Still referring to FIG. 5C, line 594 represents a value of at least one rheological property of at least a portion of a viscous medium 450 in the viscous medium conduit 410. For example, line 594 may represent a magnitude of the viscosity of the viscous medium 450 that is located within the inlet port 34. In addition, line 560 may represent the control signals generated and/or transmitted to at least the acoustic transducer 402 that is configured to emit acoustic signals that transfer acoustic waves to the inlet port 34, such that the acoustic transducer 402 is configured to emit acoustic signals that transfer acoustic waves to the viscous medium 450 (e.g., "local" viscous medium) represented by line 594. Accordingly, as shown in FIG. 5C, at least one rheological property of the local viscous medium 450, including viscosity as shown in FIG. 5C, may be adjusted based on a control signal 590 being generated and/or transmitted to the acoustic transducer 402.

As shown in FIG. 5C, in some example embodiments, an acoustic transducer may be controlled to emit acoustic signals during, before, and/or after a viscous medium supply 430 is controlled to induce a flow of viscous medium 450 through the viscous medium conduit 410. As a result, as shown in FIG. 5C, the acoustic transducer may control one or more rheological properties of at least a portion of the viscous medium 450 in the jetting device during and/or before and/or after the viscous medium supply 430 induces the flow of viscous medium 450, thereby reducing and/or mitigating the risk of reduced homogeneity in the viscous medium 450 which could lead to non-uniform flow of viscous medium 450 through the viscous medium conduit 410.

In some example embodiments, including the example embodiments shown in FIG. 5C, control signal 590 may be generated and/or transmitted continuously from a time starting at time $t_{610}$ that is a particular period of elapsed time $t_{3,start}$ preceding the viscous medium supply 430 being commanded to begin inducing the flow of viscous medium 450. As a result, during the period of time preceding time $t_{610}$, the acoustic transducer may not emit any acoustic signals, and the acoustic transducer may initiate the emission of acoustic signals at time $t_{610}$.

As shown in FIG. 5C, at time $t_{610}$, control signal 590 may be initiated and/or increased in magnitude, which may cause the acoustic transducer to initiate the emission ("transmission") of acoustic signals into the local viscous medium 450 to which acoustic signals emitted by the acoustic transducer may transfer acoustic waves.

As shown in FIG. 5C, the control signal 590 may be maintained continuously until the time $t_{640}$ which may be a period of elapsed time $t_{3,stop}$ following the commanding of the viscous medium supply 430 at time $t_{630}$ to inhibit the flow of viscous medium 450. At time $t_{640}$, the transmitted and/or generated control signal 590 may be inhibited and/or reduced in magnitude, such that the acoustic transducer is caused to cease the emission of acoustic signals.

As shown in FIG. 5C, a rheological property (e.g., viscosity) of at least a portion of viscous medium to which acoustic signals emitted by the acoustic transducer may transfer acoustic waves (e.g., viscous medium in the inlet port 34 if and/or when the acoustic transducer controlled by control signal 590 is acoustic transducer 402), which may be viscosity thereof, is adjusted from a first value to a second, different value from time $t_{610}$ to time $t_{640}$ based on the acoustic transducer being controlled via control signal 590 to emit acoustic signals during that period of time. For example, as shown in FIG. 5C, a viscosity of at least a portion of viscous medium may be reduced, based on acoustic actuation, from time $t_{610}$ to time $t_{640}$. In some example embodiments, a viscosity of at least a portion of viscous medium may be increased, based on acoustic actuation, from time $t_{610}$ to time $t_{640}$. As a result, the rheological homogeneity of the viscous medium located throughout the jetting device 1 may be improved, which may lead to improved uniformity of viscous medium 450 flow and droplet 460 properties throughout the jetting operation.

In some example embodiments, one or more of $t_{3,start}$ and $t_{3,stop}$ may be a null value (e.g., $t_{610}=t_{620}$ and/or $t_{630}=t_{640}$), such that the acoustic transducer and the viscous medium supply 430 may be commanded to simultaneously initiate or inhibit acoustic signal emission and viscous medium 450 flow, respectively.

Figure 6:
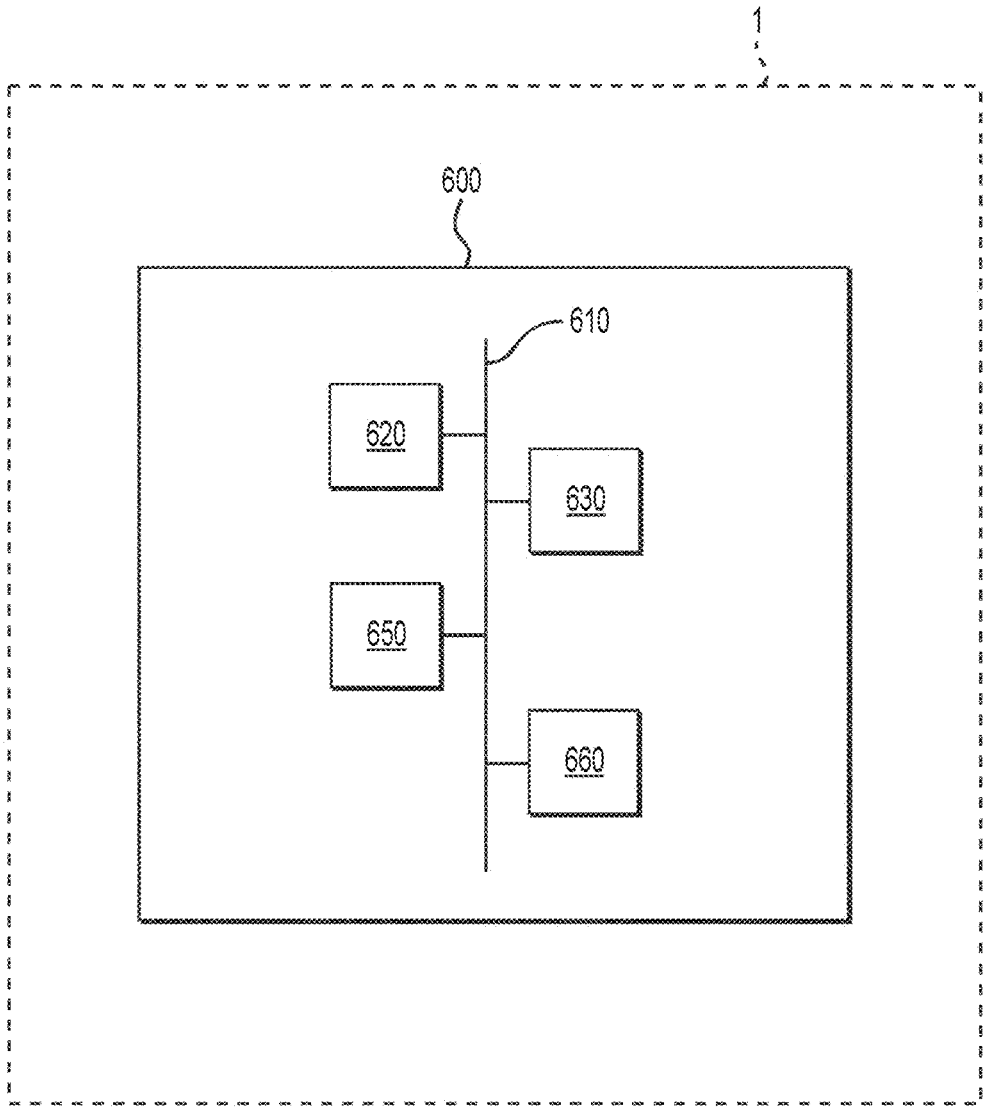
FIG. 6 is a schematic diagram illustrating a jetting device that includes a control device according to some example embodiments of the technology disclosed herein.

FIG. 6 is a schematic diagram illustrating a jetting device 1 that includes a control device 600 according to some example embodiments of the technology disclosed herein. The jetting device 1 shown in FIG. 6 may be a jetting device 1 according to any of the example embodiments illustrated and described herein, including any one of the jetting devices 1 illustrated in FIGS. 1-3 and FIGS. 4A-4B.

Referring to FIG. 6, the control device 600 includes a memory 620, a processor 630, a communication interface 650, and a control interface 660.

In some example embodiments, including the example embodiments shown in FIG. 6, the control device 600 may be included in a jetting device 1. In some example embodiments, the control device 600 may include one or more computing devices. A computing device may include a personal computer (PC), a tablet computer, a laptop computer, a netbook, some combination thereof, or the like.

The memory 620, the processor 630, the communication interface 650, and the control interface 660 may communicate with one another through a bus 610.

The communication interface 650 may communicate data from an external device using various network communication protocols. For example, the communication interface 650 may communicate sensor data generated by a sensor (not illustrated) of the control device 600 to an external device. The external device may include, for example, an image providing server, a display device, a mobile device such as, a mobile phone, a smartphone, a personal digital assistant (PDA), a tablet computer, and a laptop computer, a computing device such as a personal computer (PC), a tablet PC, and a netbook, an image outputting device such as a TV and a smart TV, and an image capturing device such as a camera and a camcorder.

The processor 630 may execute a program of instructions and control the control device 600. The processor 630 may execute a program of instructions to control one or more portions of the jetting device 1 via generating and/or transmitting control signals to one or more elements of the jetting device 1 via one or more control interfaces 660. A program of instructions to be executed by the processor 630 may be stored in the memory 620.

The memory 620 may store information. The memory 620 may be a volatile or a nonvolatile memory. The memory 620 may be a non-transitory computer readable storage medium. The memory may store computer-readable instructions that, when executed by at least the processor 630, cause the at least the processor 630 to execute one or more methods, functions, processes, etc. as described herein. In some example embodiments, the processor 630 may execute one or more of the computer-readable instructions stored at the memory 620.

In some example embodiments, the control device 600 may transmit control signals to one or more of the elements of the jetting device 1 to execute and/or control a jetting operation whereby one or more droplets are jetted to a substrate and one or more acoustic transducers are controlled to emit one or more acoustic signals. For example, the control device 600 may transmit one or more sets of control signals to one or more actuators, flow generators, acoustic transducers, some combination thereof, or the like, according to one or more programs of instruction. Such programs of instruction, when implemented by the control device 600 may result in the control device 600 generating and/or transmitting control signals to one or more elements of the jetting device 1 to cause the jetting device 1 to perform one or more jetting operations.

In some example embodiments, the control device 600 may generate and/or transmit one or more sets of control signals according to any of the timing charts illustrated and described herein, including the timing charts illustrated in FIGS. 5A-5C and FIGS. 7A-7C. In some example embodiments, the processor 630 may execute one or more programs of instruction stored at the memory 620 to cause the processor 630 to generate and/or transmit one or more sets of control signals according to any of the timing charts illustrated and described herein, including the timing charts illustrated in FIGS. 5A-5C.

In some example embodiments, the communication interface 650 may include a user interface, including one or more of a display panel, a touchscreen interface, a tactile (e.g., "button," "keypad," "keyboard," "mouse," "cursor," etc.) interface, some combination thereof, or the like. Information may be provided to the control device 600 via the communication interface 650 and stored in the memory 620. Such information may include information associated with the board 2, information associated with the viscous medium to be jetted to the board 2, information associated with one or more droplets of the viscous medium, some combination thereof, or the like. For example, such information may include information indicating one or more properties associated with the viscous medium, one or more properties (e.g., size) associated with one or more droplets to be jetted to the board 2, some combination thereof, or the like.

In some example embodiments, the communication interface 650 may include a USB and/or HDMI interface. In some example embodiments, the communication interface 650 may include a wireless network communication interface.

Figures 7A, 7B, 7C:
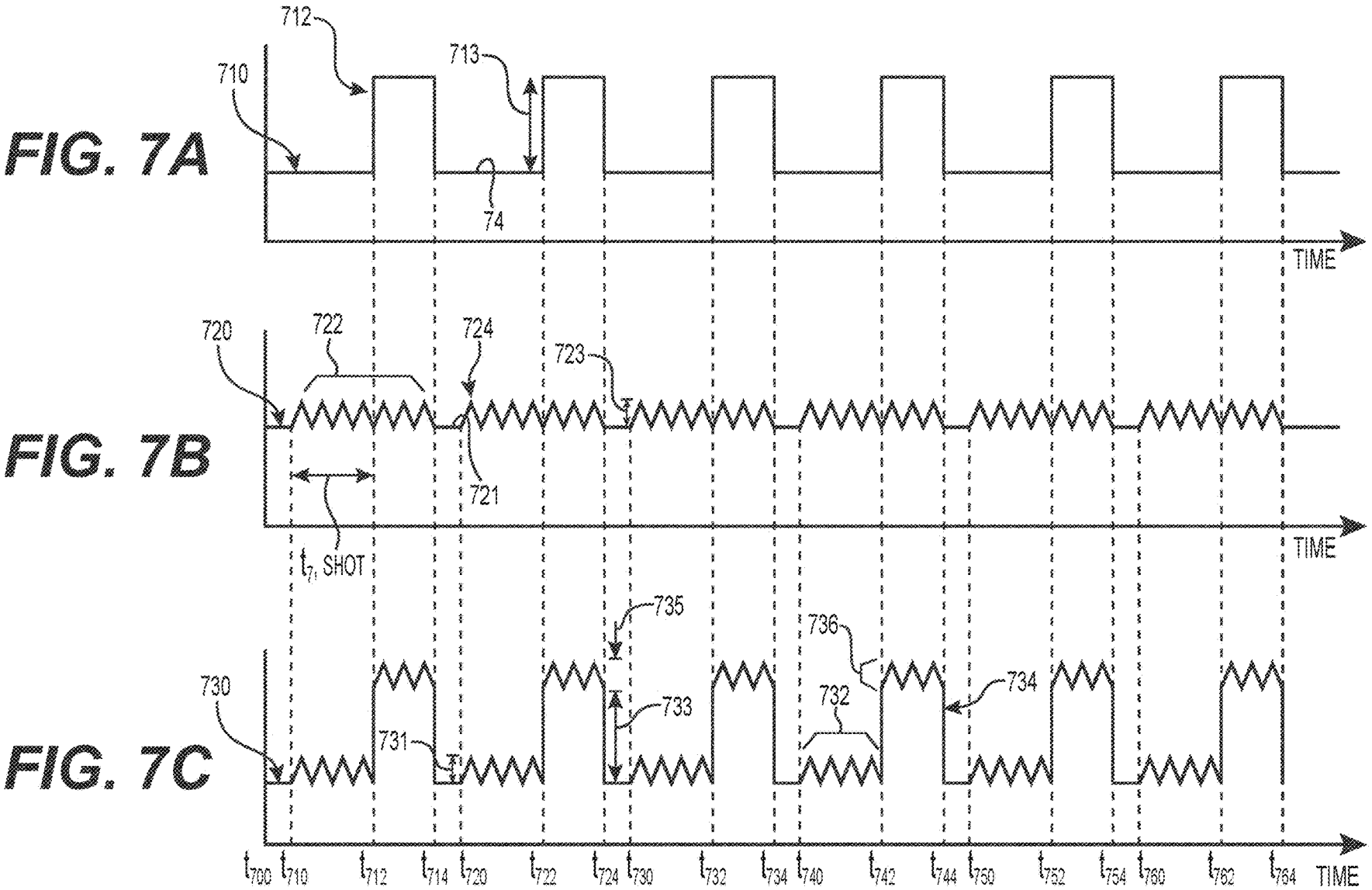
FIG. 7A is a timing chart illustrating actuator control signals transmitted over time to an actuator of the jetting device illustrated in FIGS. 4A-4B to cause the actuator to cause one or more droplets to be jetted according to some example embodiments of the technology disclosed herein.
FIG. 7B is a timing chart illustrating acoustic control signals transmitted over time to an actuator of the jetting device illustrated in FIGS. 4A-4B to cause the actuator to emit acoustic signals according to some example embodiments of the technology disclosed herein.
FIG. 7C is a timing chart illustrating combined control signals transmitted over time to an actuator of the jetting device illustrated in FIGS. 4A-4B to cause the actuator to cause one or more droplets to be jetted and to emit acoustic signals according to some example embodiments of the technology disclosed herein.

FIG. 7A is a timing chart illustrating actuator control signals transmitted over time to an actuator of the jetting device illustrated in FIGS. 4A-4B to cause the actuator to cause one or more droplets to be jetted according to some example embodiments of the technology disclosed herein. FIG. 7B is a timing chart illustrating acoustic control signals transmitted over time to an actuator of the jetting device illustrated in FIGS. 4A-4B to cause the actuator to emit acoustic signals according to some example embodiments of the technology disclosed herein. FIG. 7C is a timing chart illustrating combined control signals transmitted over time to an actuator of the jetting device illustrated in FIGS. 4A-4B to cause the actuator to cause one or more droplets to be jetted and to emit acoustic signals according to some example embodiments of the technology disclosed herein.

In some example embodiments, a jetting device includes an acoustic transducer that is implemented by one or more elements of the jetting device that are configured to execute the jetting of a droplet. For example, the actuator 21 of the jetting device 1 illustrated in FIGS. 4A-4B may be configured to be controlled to implement an acoustic transducer, such that the actuator 21 is configured to emit an acoustic signal into viscous medium that is in fluid communication with the actuator 21.

The actuator 21 may be controlled such that, in addition to moving to cause a viscous medium to be moved through the nozzle 26 to be jetted as a droplet, the actuator 21 may be further actuated according to an acoustic frequency such that the actuator 21 generates and emits an acoustic signal into the viscous medium that is in fluid communication with the actuator 21, including viscous medium that is located in at least a portion of the eject chamber 28.

In some example embodiments, the sequence of actuator 21 motion corresponding to generating and emitting the acoustic signal may be combined with the sequence of actuator motion corresponding to implementing droplet jetting to establish a single control signal sequence that may simultaneously control the actuator 21 to both move viscous medium through the eject chamber 28 to cause one or more droplets to be jetted through the outlet 27 of the nozzle 26 and to also generate and emit one or more acoustic signals into at least a portion of the viscous medium located in the eject chamber 28. The actuator 21 may then be controlled, based on transmitting the combined control sequence to the actuator 21.

Referring first to FIG. 7A, an actuator 21 may be controlled according to an actuator control signal 710 that causes the actuator 21 to move at least partially through the eject chamber 28, at various times, to cause one or more droplets to be jetted from the jetting device. The actuator control signal 710 shown in FIG. 7A may correspond to the actuator control signal 550 illustrated and described with reference to at least FIGS. 5A-5B.

As shown in FIG. 7A, the actuator control signal 710 may include one or more pulses 712 wherein the magnitude of the control signal is pulsed from an initial magnitude 711 to a pulse magnitude 713. Each pulse 712 may correspond to a "shot" of a jetting operation, where the pulse 712, upon being transmitted to the actuator 21, causes the actuator to move at least partially through the eject chamber 28 to cause a droplet to be jetted through the outlet 27 of the nozzle 26, thereby implementing an individual "shot" of a jetting operation.

Referring now to FIG. 7B, an actuator 21 may be controlled according to an acoustic control signal 720 that causes the actuator 21 to move reversibly according to an acoustic frequency to cause the actuator to generate and emit an acoustic signal into viscous medium, in the eject chamber 28, that is in fluid communication with the actuator 21.

As shown in FIG. 7B, the acoustic control signal 720 may include a sequence of acoustic pulse sets 722. Each set 722 may include a set of signal pulses 724 that repeatedly, over a particular period of time, pulse the signal 720 magnitude from an initial magnitude 720 to a pulse magnitude 723.

Each pulse set 722 may a sequence of pulses 724 that occur at a particular frequency that corresponds to a particular (or, alternatively, predetermined) acoustic frequency. Based on transmitting control signal 720 having a set 722 of pulses 724 to the actuator 21, the set 722 of pulses 724 may cause the actuator 21 to repeatedly and reversibly move (e.g., "vibrate," move "back and forth," etc.) according to the acoustic frequency, such that the actuator generates and emits an acoustic signal having the acoustic frequency for the period of time corresponding to the period of time during which the set 722 of pulses 724 are transmitted to the actuator 21.

As further shown in FIG. 7B, the control signal 720 may include a set 722 of pulses 724 that are transmitted to the actuator 21 at a time (e.g., time t710) preceding the time (e.g., time $t_{712}$) at which the pulse 712 is transmitted to the actuator 21 to cause the actuator 21 to move viscous medium through the nozzle to cause a droplet to be jetted through the outlet 27 of the nozzle 26. As shown in FIG. 7B, the set 722 of pulses 724 may be transmitted to the actuator 21 a particular amount of time $t_{7,shot}$ prior to the time (e.g., time $t_{712}$) at which the pulse 712 is transmitted to the actuator 21 to cause the actuator 21 to move viscous medium through the nozzle to cause a droplet to be jetted through the outlet 27 of the nozzle 26.

As further shown in FIG. 7B, the set 722 of pulses 724 may continue through the period of time (e.g., between times $t_{712}$ and $t_{714}$) during which the pulse 712 is transmitted to the actuator 21 to cause a shot to be implemented. In FIG. 7B, the pulse 722 ends at the same time (e.g., time $t_{714}$) as pulse 712, but example embodiments are not limited thereto. For example, pulse 722 may end after the time at which pulse 712 ends or prior to the time at while pulse 712 ends.

Referring now to FIG. 7C, the control signals 710 and 720 may be combined to generate a combined control signal 730 that may be transmitted to the actuator 21 to cause the actuator 21 to both move viscous medium through the eject chamber 28 to cause one or more droplets to be jetted through the outlet 27 of the nozzle 26 and to also generate and emit one or more acoustic signals into at least a portion of the viscous medium located in the eject chamber 28.

As shown in FIG. 7C, control signal 730 may be caused by combining control signals 710 and 720 such that the control signal 730 includes pulses 734 corresponding to pulses 712 of the actuator control signal 710 and further includes pulses 732 corresponding to pulses 724 of the acoustic control signal 720.

Thus, control signal 730 shows a sequence of smaller pulses 732 having a magnitude 731 that are initiated at a particular time and according to a particular frequency to cause the actuator 21 to generate and emit an acoustic signal having an acoustic frequency. After a particular period of time $t_{7,shot}$, a pulse 734 having magnitude 733 is generated to cause the actuator 21 to implement a shot.

As further shown in FIG. 7C, because the pulses 724 of control signal 720 and pulses 712 of control signal 710 occur at partially overlapping times, the combined control signal 730 shows that the magnitude of the combined control signal 730 is initially pulsed to magnitude 731 prior to pulse 734, thereby corresponding to the pulses 724 that occur prior to pulse 712, and the magnitude of the combined control signal 730 is further pulsed (e.g., "modulated") from magnitude 733 to magnitude 735 when pulse 734 is generated, such that pulses 736 that correspond to the pulses 724 occurring concurrently with pulse 712 are transmitted to the actuator 21. As a result, the actuator 21 may be caused to generate and emit acoustic signals according to pulses 736 while simultaneously implementing a shot according to pulse 734. The changes in the magnitude of the combined control signal 730 that are caused by pulses 732 and 736 may be the same or different, and the frequencies of pulses 732 and 736 may the same or different.

The control signals 710, 720, 730 illustrated and described above may be generated and/or transmitted by a control device included in the jetting device 1, including the control device 600 illustrated in FIG. 6. Based on enabling the actuator to be controlled to implement an acoustic transducer, a jetting device may be configured to provide the advantages provided by an acoustic transducer in the jetting device, described above, without including a separate acoustic transducer element, thereby reducing costs of manufacture of jetting devices configured to implement the acoustic transducer.

The foregoing description has been provided for purposes of illustration and description. It is not intended to be exhaustive. Individual elements or features of a particular example embodiment are generally not limited to that particular example, but are interchangeable where applicable and can be used in a selected embodiment, even if not specifically shown or described. The same may also be varied in many ways. Such variations are not to be regarded as a departure from example embodiments, and all such modifications are intended to be included within the scope of the example embodiments described herein.

ITEMIZED EMBODIMENTS

1. A software controlled ejector configured to jet a droplet of a viscous medium, the device comprising:

a nozzle including an outlet, the nozzle configured to jet the droplet through the outlet;

a viscous medium conduit configured to direct a flow of the viscous medium to the outlet of the nozzle; and an acoustic transducer configured to emit an acoustic signal that transfers acoustic waves into at least a portion of the viscous medium located in the viscous medium conduit a memory configured to store a program of instructions; and a processor configured to execute the program of instructions to, control an actuator of a jetting device, according to a predetermined actuator control sequence, to jet a sequence of droplets of a viscous medium through a jetting outlet of the jetting device on to a substrate, and control an acoustic transducer configured to direct a quantum of energy into at least a portion of the viscous medium that is based or dependent on the actuator control sequence.

2. The device of claim 1, wherein, the viscous medium conduit at least partially defines an eject chamber in fluid communication with the outlet of the nozzle, the eject chamber configured to receive a portion of an actuator to move viscous medium located within the eject chamber through the outlet of the nozzle, and the acoustic transducer is configured to emit an acoustic signal that transfers acoustic waves into viscous medium located within the eject chamber.

3. The device of claim 1, wherein, the device further includes an actuator configured to induce the flow of the viscous medium through the viscous medium conduit; and the portion of the viscous medium conduit at least partially encloses the actuator.

4. The device of claim 1, wherein, the acoustic transducer includes a plurality of acoustic transducers, each acoustic transducer configured to emit acoustic signals that transfer acoustic waves into a separate portion of the viscous medium conduit, each acoustic transducer further configured to be separately and independently controlled to emit separate, respective acoustic signals into viscous medium located in the separate, respective portions of the viscous medium conduit.

5. The device of claim 1, further comprising:

a control device configured to control the acoustic transducer to emit the acoustic signal based at least in part upon a jetting of one or more droplets through the outlet of the nozzle.

6. The device of claim 1, further comprising:

a flow sensor configured to generate flow data based on measuring the flow of the viscous medium through at least a portion of the viscous medium conduit; and a control device configured to control the acoustic transducer to emit the acoustic signal based at least in part upon the flow data.

7. A method for controlling a jetting of one or more droplets of a viscous medium through an outlet of a nozzle, the method comprising:

controlling a viscous medium supply to induce a flow of the viscous medium through a viscous medium conduit to the outlet of the nozzle;

controlling an actuator of a jetting device, according to a predetermined actuator control sequence, to jet a sequence of droplets of a viscous medium through a jetting outlet of the jetting device on to a substrate; and controlling an acoustic transducer to emit an acoustic signal into at least a portion of the viscous medium that is located within the viscous medium conduit, wherein the controlling of the acoustic transducer is based or dependent on the actuator control sequence.

8. The method of claim 7, wherein, the controlling the acoustic transducer includes commanding the acoustic transducer to emit the acoustic signal for a particular, limited period of time.

9. The method of claim 7, wherein, the controlling the acoustic transducer includes commanding the acoustic transducer to emit the acoustic signal based on the viscous medium supply being controlled to induce the flow of the viscous medium.

10. The method of claim 7, wherein, the viscous medium conduit at least partially defines an eject chamber in fluid communication with the outlet of the nozzle, the eject chamber configured to receive a portion of an actuator to move viscous medium within the eject chamber through the outlet of the nozzle, and the controlling the acoustic transducer includes commanding the acoustic transducer to emit the acoustic signal based on the actuator being controlled to extend into the eject chamber.

11. The method of claim 7, wherein, the acoustic transducer includes a plurality of acoustic transducers, each acoustic transducer configured to be in direct fluid communication with a separate portion of the viscous medium conduit; and the controlling the acoustic transducer includes separately and independently commanding the separate, respective acoustic transducers of the plurality of acoustic transducers to emit separately, respective acoustic signals into separate, respective portions of the viscous medium within the viscous medium conduit.

12. The method of claim 7, wherein, the controlling the acoustic transducer includes commanding the acoustic transducer to emit the acoustic signal based on flow data received from a flow sensor, the flow data indicating the flow of the viscous medium through at least a portion of the viscous medium conduit.

13. A software controlled jetting apparatus, comprising:

a nozzle including an outlet, the nozzle configured to jet the droplet through the outlet;

a viscous medium conduit configured to direct a flow of the viscous medium to the outlet of the nozzle;

a memory configured to store a program of instructions; and a processor configured to execute the program of instructions to, control an actuator of a jetting device, according to a predetermined actuator control sequence, to jet a sequence of droplets of a viscous medium through a jetting outlet of the jetting device on to a substrate, and control an acoustic transducer configured to direct a quantum of energy into at least a portion of the viscous medium, based on acoustic actuation of the portion of the viscous medium, wherein the controlling of the acoustic transducer is also based or dependent on the actuator control sequence.

14. The apparatus of claim 13, wherein the acoustic transducer is configured to, based on the acoustic actuation of the portion of the viscous medium, induce at least one of, increased homogeneity of spacing of particles in at least the portion of the viscous medium, and shear-thinning of a carrier fluid in at least the portion of the viscous medium based on the acoustic actuation of the portion of the viscous medium, such that a viscosity of at least the carrier fluid is adjusted.

15. The apparatus of claim 13, wherein, the jetting device includes a nozzle including an outlet, the nozzle configured to jet the one or more droplets through the outlet;

the jetting device further includes a viscous medium conduit that at least partially defines an eject chamber in fluid communication with the outlet of the nozzle, the eject chamber configured to receive a portion of an actuator to move viscous medium within the eject chamber through the outlet of the nozzle; and the acoustic transducer configured to emit an acoustic signal into viscous medium located within the eject chamber.

16. The apparatus of claim 13, wherein, the jetting device includes a nozzle including an outlet, the nozzle configured to jet the one or more droplets through the outlet;

the jetting device further includes an actuator configured to induce a flow of viscous medium through a viscous medium conduit;

the jetting device further includes a viscous medium conduit configured to direct the flow of viscous medium to the outlet of the nozzle, at least a portion of the viscous medium conduit at least partially enclosing the actuator; and the acoustic transducer is configured to emit an acoustic signal that transfers acoustic waves into a portion of the viscous medium conduit.

17. The apparatus of claim 13, further comprising:

a control device configured to control the acoustic transducer to emit the acoustic signal based at least in part upon a jetting of one or more droplets.

18. The apparatus of claim 13, further comprising:

a flow sensor configured to generate flow data based on measuring a flow of viscous medium through at least a portion of a viscous medium conduit; and a control device configured to control the acoustic transducer to emit the acoustic signal based at least in part upon the flow data.

19. The apparatus of claim 13, wherein, the acoustic transducer includes a plurality of acoustic transducers, each acoustic transducer configured to be separately and independently controlled to emit separate, respective acoustic signals into separate, respective portions of the viscous medium within the jetting device.

20. A method for controlling a jetting of one or more droplets of a viscous medium through an outlet of a nozzle, the method comprising:

controlling an actuator of a jetting device, according to a predetermined actuator control sequence, to jet a sequence of droplets of a viscous medium through a jetting outlet of the jetting device on to a substrate;

controlling a viscous medium supply to induce a flow of the viscous medium through a viscous medium conduit to the outlet of the nozzle; and controlling an acoustic transducer to adjust one or more rheological properties of a portion of viscous medium that is located within the viscous medium conduit, based on acoustic actuation of the portion of viscous medium, wherein the controlling of the acoustic transducer is also based or dependent on the actuator control sequence.

21. The method of claim 20, wherein the adjusting one or more rheological properties of the portion of viscous medium includes at least one of, inducing increased homogeneity of a spacing of particles in at least the portion of viscous medium, inducing oscillatory break-up of one or more agglomerations of particles in at least the portion of viscous medium, adjusting a viscosity of a carrier fluid in at least the portion of viscous medium based on inducing shear-thinning, and inducing a reduction in a volume fraction in at least the portion of viscous medium.

22. The method of claim 20, wherein, the controlling the acoustic transducer includes commanding the acoustic transducer to emit an acoustic signal for a particular, limited period of time.

23. The method of claim 20, wherein, the controlling the acoustic transducer includes commanding the acoustic transducer to emit an acoustic signal based on the viscous medium supply being controlled to induce the flow of the viscous medium.

24. The method of claim 20, wherein, the viscous medium conduit at least partially defines an eject chamber in fluid communication with the outlet of the nozzle, the eject chamber configured to receive a portion of an actuator to move viscous medium located within the eject chamber through the outlet of the nozzle, and the controlling the acoustic transducer includes commanding the acoustic transducer to emit an acoustic signal based on the actuator being controlled to extend into the eject chamber.

25. The method of claim 20, wherein, the acoustic transducer includes a plurality of acoustic transducers, each acoustic transducer configured to emit an acoustic signal that transfers acoustic waves into a separate portion of the viscous medium conduit; and the controlling the acoustic transducer includes separately and independently commanding the separate, respective acoustic transducers of the plurality of acoustic transducers to emit separate, respective acoustic signals that transfer acoustic waves into separate, respective portions of the viscous medium within the viscous medium conduit.

What is claimed is:

1. A device configured to jet one or more droplets of a viscous medium, the device comprising:

a nozzle including an outlet, the nozzle configured to jet the one or more droplets of the viscous medium through the outlet of the nozzle;

a viscous medium conduit configured to direct a flow of the viscous medium to the outlet of the nozzle;

an acoustic transducer configured to emit an acoustic signal that transfers acoustic waves into at least a portion of the viscous medium located in the viscous medium conduit; and a control device configured to control the acoustic transducer to emit the acoustic signal during a jetting operation that includes jetting one or more droplets of the viscous medium through the outlet of the nozzle.

2. The device of claim 1, wherein, the viscous medium conduit at least partially defines an eject chamber in fluid communication with the outlet of the nozzle, the eject chamber configured to receive a portion of an actuator to move viscous medium located within the eject chamber through the outlet of the nozzle, and the acoustic transducer is configured to emit the acoustic signal such that the acoustic signal transfers acoustic waves into viscous medium located within the eject chamber.

3. The device of claim 1, wherein, the device further includes an actuator configured to induce the flow of the viscous medium through the viscous medium conduit; and the portion of the viscous medium conduit at least partially encloses the actuator.

4. The device of claim 1, further comprising:

a plurality of acoustic transducers, the plurality of acoustic transducers including the acoustic transducer, each acoustic transducer configured to emit acoustic signals that transfer acoustic waves into a separate portion of the viscous medium conduit, each acoustic transducer further configured to be separately and independently controlled to emit separate, respective acoustic signals into viscous medium located in the separate, respective portions of the viscous medium conduit.

5. The device of claim 1, further comprising:

a flow sensor configured to generate flow data based on measuring the flow of the viscous medium through at least a portion of the viscous medium conduit, wherein the control device is configured to control the acoustic transducer to emit the acoustic signal based at least in part upon the flow data.

6. The device of claim 1, wherein the device further includes an actuator configured to induce the flow of the viscous medium through the viscous medium conduit, and the control device is configured to generate a control signal that causes the acoustic transducer to emit the acoustic signal concurrently with the control device generating a separate control signal that causes the actuator to induce the flow of the viscous medium through the viscous medium conduit to jet an individual droplet of the one or more droplets.

7. The device of claim 6, wherein the jetting of the one or more droplets includes jetting a plurality of separate droplets through the outlet of the nozzle over a period of time, and the control device is configured to control the acoustic transducer to emit the acoustic signal continuously over at least the period of time, concurrently with the control device generating a plurality of separate control signals during the period of time that causes the actuator to induce the flow of the viscous medium through the viscous medium conduit to jet the plurality of separate droplets through the outlet of the nozzle over the period of time.

8. The device of claim 1, wherein the jetting of the one or more droplets includes jetting a plurality of separate droplets through the outlet of the nozzle over a period of time, the device further includes an actuator configured to induce the flow of the viscous medium through the viscous medium conduit, the control device is configured to generate a plurality of first control signal pulses over the period of time that cause the actuator to induce the flow of the viscous medium through the viscous medium conduit to jet the plurality of separate droplets through the outlet of the nozzle over the period of time, and the control device is further configured to generate a plurality of second control signal pulses over the period of time that cause the acoustic transducer to emit the acoustic signal in a set of separate acoustic signal pulses that are synchronized with the jetting of the plurality of separate droplets over the period of time, such that at least one rheological property of the portion of the viscous medium located in the viscous medium conduit is adjusted in a set of separate pulses between different values of the at least one rheological property that occur concurrently with separate, respective droplets of the plurality of separate droplets being jetted through the outlet of the nozzle.

9. A method for controlling a jetting of one or more droplets of a viscous medium through an outlet of a nozzle, the method comprising:

controlling a viscous medium supply to induce a flow of the viscous medium through a viscous medium conduit to the outlet of the nozzle; and controlling an acoustic transducer to emit an acoustic signal into at least a portion of the viscous medium that is located within the viscous medium conduit, wherein the viscous medium conduit at least partially defines an eject chamber in fluid communication with the outlet of the nozzle, the eject chamber configured to receive a portion of an actuator to move viscous medium within the eject chamber through the outlet of the nozzle to cause one or more droplets of the viscous medium to be jetted through the outlet of the nozzle, wherein the controlling the acoustic transducer includes commanding the acoustic transducer to emit the acoustic signal during a jetting operation that includes the actuator being controlled to extend into the eject chamber to cause one or more droplets of the viscous medium to be jetted through the outlet of the nozzle.

10. The method of claim 9, wherein, the controlling the acoustic transducer includes commanding the acoustic transducer to emit the acoustic signal for a particular, limited period of time.

11. The method of claim 9, wherein, the controlling the acoustic transducer further includes commanding the acoustic transducer to emit the acoustic signal based on the viscous medium supply being controlled to induce the flow of the viscous medium.

12. The method of claim 9, wherein, the acoustic transducer is one of a plurality of acoustic transducers, each acoustic transducer configured to be in direct fluid communication with a separate portion of the viscous medium conduit; and the method includes separately and independently commanding separate, respective acoustic transducers of the plurality of acoustic transducers to emit separate, respective acoustic signals into separate, respective portions of the viscous medium within the viscous medium conduit.

13. The method of claim 9, wherein, the controlling the acoustic transducer includes commanding the acoustic transducer to emit the acoustic signal based on flow data received from a flow sensor, the flow data indicating the flow of the viscous medium through at least a portion of the viscous medium conduit.

14. The method of claim 9, wherein the commanding the acoustic transducer to emit the acoustic signal during the jetting operation includes generating a control signal that causes the acoustic transducer to emit the acoustic signal concurrently with generating a separate control signal that causes the actuator to extend into the eject chamber to cause an individual droplet of the one or more droplets to be jetted through the outlet of the nozzle.

15. The method of claim 14, wherein the commanding the acoustic transducer to emit the acoustic signal during the jetting operation includes commanding the acoustic transducer to emit the acoustic signal continuously over at least a period of time, concurrently with the actuator repeatedly extending into the eject chamber to cause a plurality of separate droplets of the viscous medium to be jetted through the outlet of the nozzle over the period of time.

16. The method of claim 9, wherein the method further includes generating a plurality of first control signal pulses over a period of time that cause the actuator to repeatedly extend into the eject chamber to cause a plurality of separate droplets of the viscous medium to be jetted through the outlet of the nozzle over the period of time, and the commanding the acoustic transducer to emit the acoustic signal during the jetting operation includes generating a plurality of second control signal pulses over the period of time that cause the acoustic transducer to emit a set of separate acoustic signal pulses that are synchronized with the plurality of separate droplets of the viscous medium being jetted over the period of time, such that at least one rheological property of the portion of the viscous medium located in the viscous medium conduit is adjusted in a set of separate pulses between different values of the at least one rheological property that occur concurrently with separate, respective droplets of the plurality of separate droplets being jetted through the outlet of the nozzle.

17. An apparatus, comprising:

a jetting device configured to jet one or more droplets of a viscous medium on a substrate, the jetting device including a nozzle including an outlet, the nozzle configured to jet the one or more droplets of the viscous medium through the outlet of the nozzle;

an acoustic transducer configured to emit an acoustic signal into at least a portion of the viscous medium to adjust one or more rheological properties of the portion of the viscous medium, based on acoustic actuation of the portion of the viscous medium; and a control device configured to control the acoustic transducer to emit the acoustic signal during a jetting operation that includes jetting one or more droplets of the viscous medium through the outlet of the nozzle.

18. The apparatus of claim 17, wherein the acoustic transducer is configured to, based on the acoustic actuation of the portion of the viscous medium, induce, shear-thinning of a carrier fluid in at least the portion of the viscous medium based on the acoustic actuation of the portion of the viscous medium, such that a viscosity of at least the carrier fluid is adjusted.

19. The apparatus of claim 17, wherein, the jetting device further includes a viscous medium conduit that at least partially defines an eject chamber in fluid communication with the outlet of the nozzle, the eject chamber configured to receive a portion of an actuator to move viscous medium within the eject chamber through the outlet of the nozzle; and the acoustic transducer is configured to emit the acoustic signal into viscous medium located within the eject chamber.

20. The apparatus of claim 17, wherein the control device is configured to generate a control signal that causes the acoustic transducer to emit the acoustic signal concurrently with the control device generating a separate control signal that causes the jetting device to jet an individual droplet of the one or more droplets.

* * * * *